US009723891B2

(12) United States Patent
Xanthos et al.

(10) Patent No.: US 9,723,891 B2
(45) Date of Patent: Aug. 8, 2017

(54) ARTICLE OF FOOTWEAR FOR ROWING

(71) Applicant: NIKE, Inc., Beaverton, OR (US)

(72) Inventors: George A. Xanthos, Beaverton, OR (US); Elizabeth A. Kilgore, Portland, OR (US); Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/687,186

(22) Filed: Apr. 15, 2015

(65) Prior Publication Data

US 2016/0302515 A1 Oct. 20, 2016

(51) Int. Cl.

| | |
|---|---|
| ***A43B 5/08*** | (2006.01) |
| ***A43B 7/08*** | (2006.01) |
| ***A43B 13/14*** | (2006.01) |
| ***A43B 23/26*** | (2006.01) |
| ***A43C 11/14*** | (2006.01) |

(52) U.S. Cl.

CPC ..... *A43B 5/08* (2013.01); *A43B 7/085* (2013.01); *A43B 13/14* (2013.01); *A43B 23/26* (2013.01); *A43C 11/1493* (2013.01)

(58) Field of Classification Search

CPC .... A43B 3/06; A43B 5/08; A43B 7/06; A43B 70/085; A43B 13/14; A43B 23/028; A43B 23/26; A43C 11/14; A43C 11/1493

USPC ..... 36/96, 99, 114, 133, 54

See application file for complete search history.

(56) References Cited

U.S. PATENT DOCUMENTS

| | | | | |
|---|---|---|---|---|
| 3,742,622 | A * | 7/1973 | Dassler | A43B 23/26 36/114 |
| 4,377,913 | A * | 3/1983 | Stone | A43C 11/1493 36/50.1 |
| 4,616,432 | A | 10/1986 | Bunch et al. | |
| 4,845,864 | A | 7/1989 | Corliss | |
| 4,901,451 | A | 2/1990 | Cumin | |
| 5,337,493 | A | 8/1994 | Hill | |
| 5,778,565 | A * | 7/1998 | Holt | A43B 1/0081 36/101 |
| 6,763,614 | B2 | 7/2004 | Smith | |
| 6,922,917 | B2 * | 8/2005 | Kerns | A43B 5/14 36/50.1 |
| 7,316,082 | B2 * | 1/2008 | Hernandez | A43B 3/0031 36/54 |
| 7,444,768 | B2 * | 11/2008 | Friton | A43B 23/26 36/50.1 |
| 7,716,854 | B2 | 5/2010 | Roux et al. | |
| 8,141,274 | B2 * | 3/2012 | Matsueda | A43B 5/00 36/131 |
| 8,156,664 | B2 * | 4/2012 | Shepherd | A43B 1/0081 36/114 |
| 8,230,617 | B2 * | 7/2012 | Luedecke | A43B 5/08 36/8.1 |
| 8,683,716 | B2 | 4/2014 | Raysse et al. | |

(Continued)

FOREIGN PATENT DOCUMENTS

EP 1712147 10/2006

*Primary Examiner* — Sharon M Prange

(74) *Attorney, Agent, or Firm* — Wissing Miller LLP

(57) ABSTRACT

An article of footwear has an upper with multiple components. The upper includes a fastening system, a shield, and a tongue. The shield and the tongue are each attached to the upper. The shield and the tongue may be readily moved to facilitate entry of a foot into the article of footwear, or exit of a foot from the article of footwear.

12 Claims, 18 Drawing Sheets

(56) References Cited

U.S. PATENT DOCUMENTS

| | | | | |
|---|---|---|---|---|
| 2013/0008057 | A1 | 1/2013 | Bird et al. | |
| 2013/0312284 | A1* | 11/2013 | Berend | A43B 1/0027 36/84 |
| 2014/0082962 | A1* | 3/2014 | Rodriguez | A43B 1/0081 36/54 |

* cited by examiner

ARTICLE OF FOOTWEAR FOR ROWING

BACKGROUND

The present embodiments relate generally to articles of footwear and, in particular, to articles of footwear for rowing and water sports.

Articles of footwear generally include two primary elements: an upper and a sole structure. The upper may be formed from a variety of materials that are stitched or bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, the present disclosure is directed to an article of footwear, the article of footwear comprising an upper, and the upper comprising a fastening system, a shield, and a tongue. The upper also includes a longitudinal direction, a lateral direction, a forefoot portion, a heel portion, an instep portion, a midline, and a central axis extending in the longitudinal direction from the forefoot portion to the heel portion. The central axis is approximately aligned with the midline of the article of footwear, and the central axis divides the upper into two opposing sides across the lateral direction. The two sides of the upper comprise a first side and a second side, and the fastening system comprises one or more fasteners and one or more fixed straps. The one or more fixed straps are attached along the second side of the upper. The shield includes a first edge, and the tongue includes a second edge, where the first edge of the shield is attached to a first portion of the second side, and the shield remains unattached along the first side of the upper. In addition, the second edge of the tongue is attached to a second portion of the second side, and the tongue remains unattached along the first side of the upper. Furthermore, at least one fastener is configured to extend over the instep portion and secure the article of footwear when tension is applied to the at least one fastener.

In another aspect, the present disclosure is directed to an article of footwear, the article of footwear comprising a lateral side, a medial side, an instep portion, an upper, a fastening system, a shield, and a tongue. The fastening system has one or more fasteners, and the one or more fasteners include a first fastener. The upper includes a closed configuration and an open configuration, where the first fastener exerts a compressive force along at least a part of the instep portion when the upper is in the closed configuration. The shield extends beneath the first fastener, and the shield includes a medial edge, where at least a portion of the medial edge of the shield is attached to the medial side of the upper by one or more anchor portions, and the shield is configured to be rotated about the one or more anchor portions. Furthermore, the tongue extends beneath the shield, and the shield comprises one or more padded regions. The shield is configured to provide cushioning to at least a portion of an instep portion of a foot when the upper is in the closed configuration.

In another aspect, the present disclosure is directed to an article of footwear, the article of footwear comprising a lateral side and a medial side, an upper, a fastening system, a shield, and a tongue, a forefoot portion, a midfoot portion, a heel portion, a vamp portion, an instep portion, a mouth, an opening, and an interior cavity. The opening provides access to the interior cavity of the upper. In addition, the instep portion includes an inner lateral edge and the shield includes a medial edge. The shield is attached along the medial edge of the shield to the medial side of the upper by one or more anchor portions, where the shield can be turned about the one or more anchor portions. The tongue includes a lateral edge and a rear edge, where the lateral edge is detached from the upper, and where the rear edge is detached from the upper. Furthermore, the upper has a secured state where the opening is a first size, and the upper has an open state where the opening is a second size, such that the second size is larger than the first size. The upper is in the secured state when the shield is disposed over the instep portion, and tension is applied to the fastening system. The upper is in the open state when the fastening system is loosened and the shield is turned toward the medial side. In addition, the instep portion includes a throat opening in the open state, where the throat opening extends between the lateral edge of the tongue and the inner lateral edge of the instep portion, and where the throat opening is continuous with the mouth. The opening is associated with the mouth in the secured state, and the opening is associated with both the mouth and the throat opening in the open state.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis is instead being placed upon illustrating the principles of the embodiments. Moreover, in the figures, like reference numerals designate corresponding parts throughout the different views.

DETAILED DESCRIPTION

Figure 1:
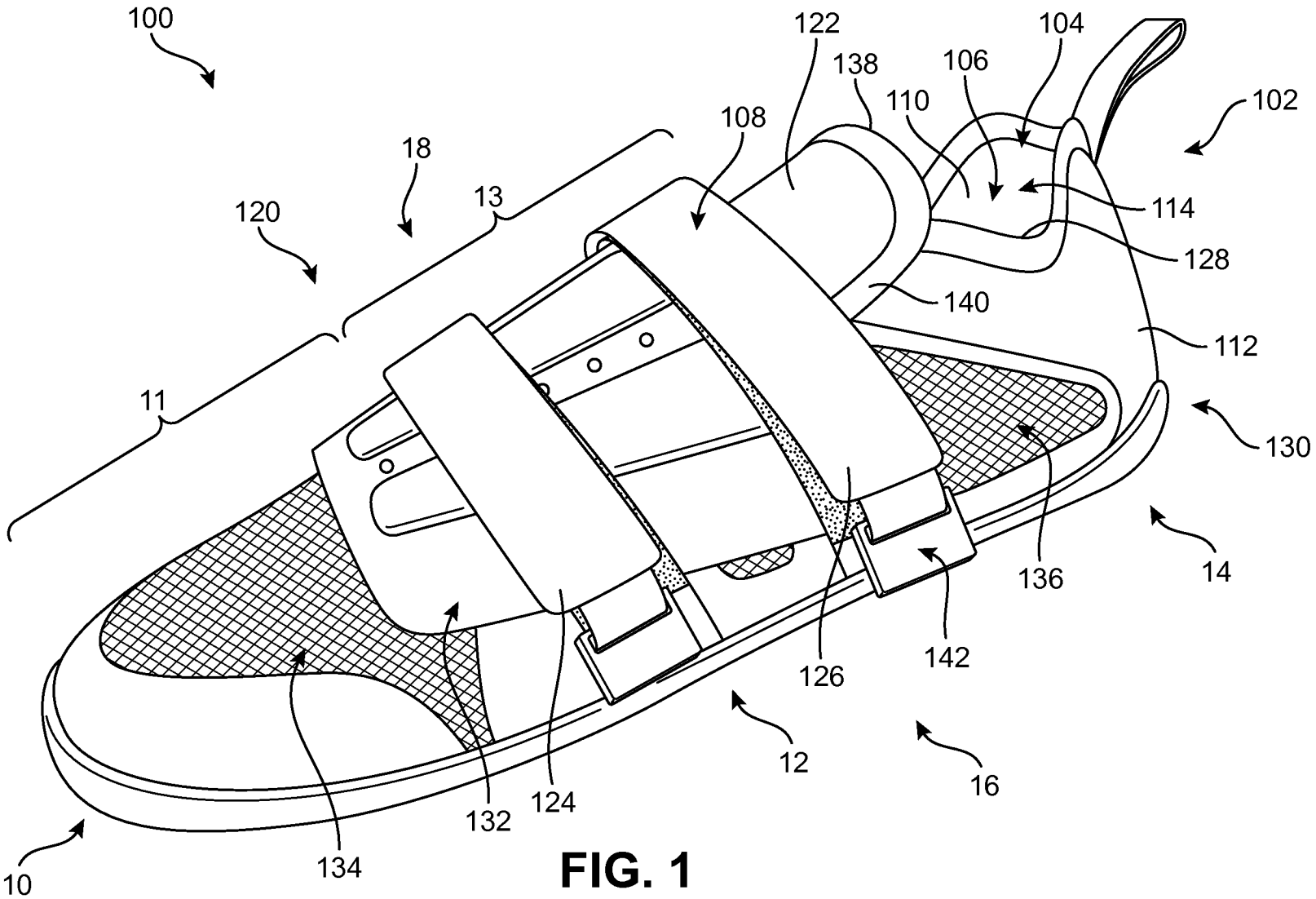
FIG. 1 is a schematic isometric view of an embodiment of an article of footwear including an upper and a sole structure.
Figure 2:
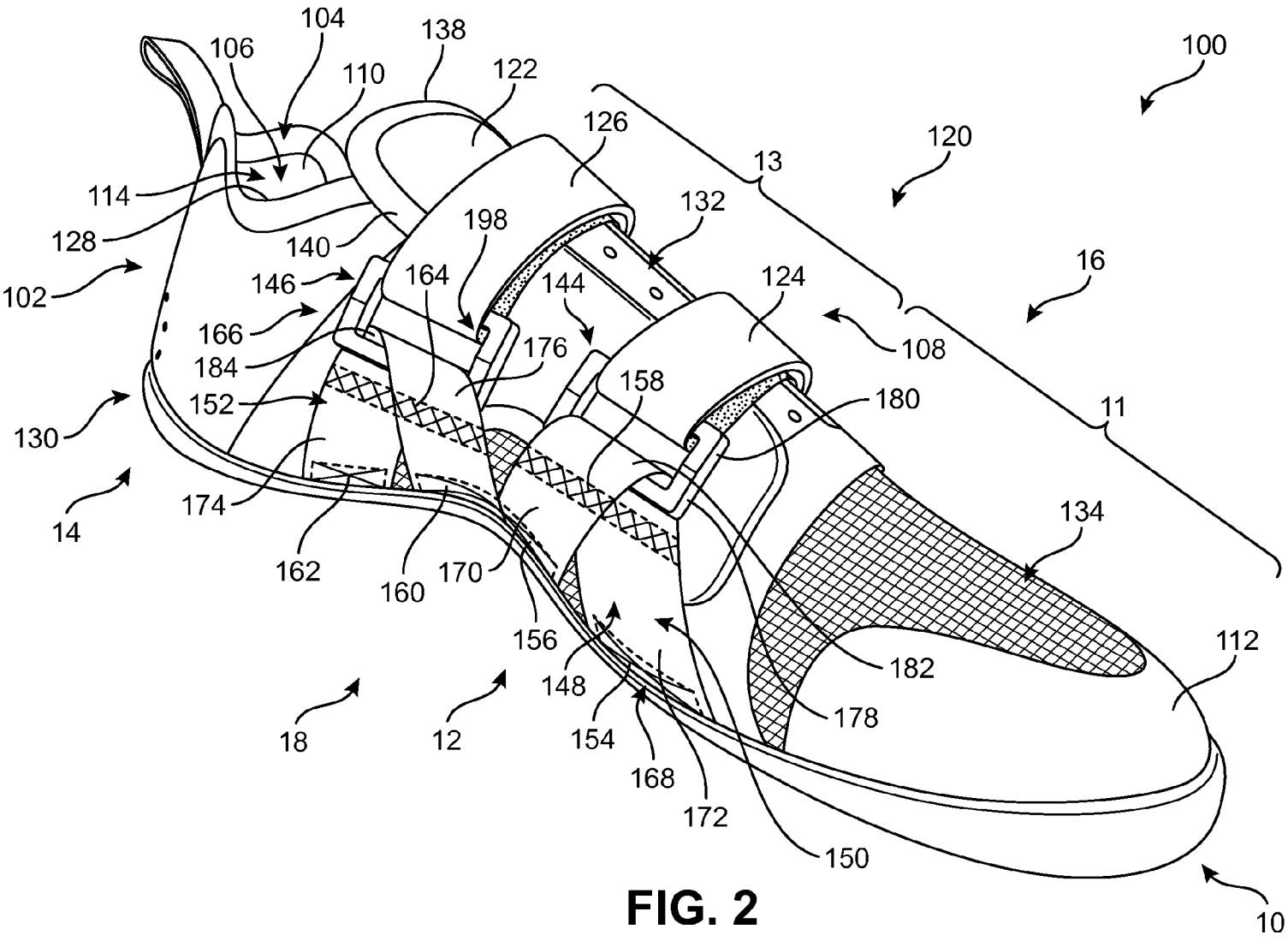
FIG. 2 is a schematic isometric view of an embodiment of an article of footwear including an upper and a sole structure.
Figure 3:
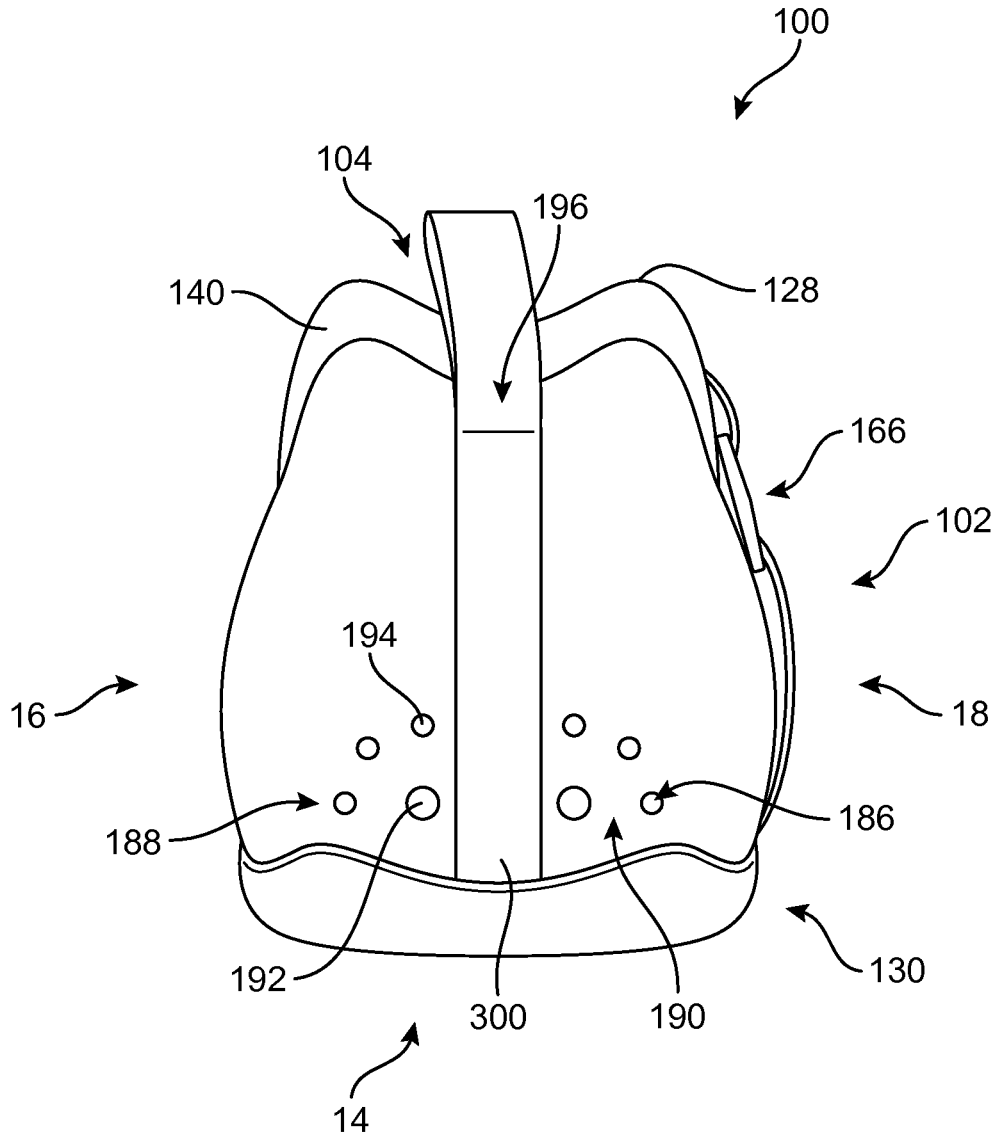
FIG. 3 is a schematic isometric view of an embodiment of an article of footwear including an upper and a sole structure.

FIGS. 1-3 depict isometric views of an embodiment of an article of footwear 100. In one embodiment, article of footwear 100 has the form of an athletic shoe for use in water sports. In some embodiments, article of footwear 100 could be a rowing shoe. In other embodiments, article of footwear 100 could be a kayaking shoe, a canoeing shoe, a windsurfing shoe, or another kind of water shoe.

Furthermore, in other embodiments, the provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, boots, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, a fastening system, an upper, or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some cases, the longitudinal direction may extend from a forefoot portion to a heel portion of the component. Also, the term "lateral" as used throughout this detailed description and in the claims refers to a direction or axis extending along a width of a component. In other words, the lateral direction may extend between a medial side and a lateral side of a component. Furthermore, the term "vertical" as used throughout this detailed description and in the claims refers to a direction or axis generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. Furthermore, the term "beneath" refers to a relative position closer toward the ground, a sole structure, and/or an interior cavity of the article of footwear. The term "above" refers to a relative position that is opposite to beneath. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion, a vamp portion, and an instep portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include a vamp portion 11 and an instep portion 13. Vamp portion 11 may be generally associated with the front part of a shoe upper that covers the toes and the area of the foot adjacent to the toes. Furthermore, instep portion 13 may be generally associated with a center section of the foot, between the toes and ankle, adjacent to vamp portion 11.

In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14, vamp portion 11, and instep portion 13. In one embodiment, it may be understood that lateral side 16 is associated with the "outboard" side and medial side 18 is associated with the "inboard" side. For purposes of this disclosure, outboard refers to the side located away from the midline of a vessel (e.g., a row boat), and inboard refers to the side located nearest to the midline of a vessel.

FIGS. 1-3 illustrate various features and components of article of footwear 100, including an upper 102 and a sole structure 130. FIG. 1 provides an isometric lateral view of an embodiment of article 100. FIG. 2 provides an isometric medial view of an embodiment of article 100. FIG. 3 provides an isometric rear view of an embodiment of article 100. In FIGS. 1-3, upper 102 has an opening 104 that may receive a foot. Opening 104 may provide access to an interior cavity 106 of upper 102, as shown in FIGS. 1 and 2. Depending on the material of upper 102, in some embodiments, upper 102 may be configured to stretch fit over a foot without the need for additional fasteners. However, in other embodiments, the use of one or more fasteners 108 may allow upper 102 to enlarge or tighten over a foot and/or provide the amount of tension desired to keep article 100 on the foot. Thus, in some embodiments, one or more fasteners 108 may be configured to provide a kind of wraparound or wrapping tension to at least a portion of article 100.

In some embodiments, sole structure 130 may be configured to provide traction for article 100. For example, sole structure 130 may include one or more traction elements, such as grooves, protrusions, or other traction devices. In one embodiment, sole structure 130 may include areas with siping along the underside (i.e., the outsole) of sole structure 130. The siping may comprise thin slits across the surface of the outsole. In some embodiments, the siping may improve traction in wet or icy conditions.

In addition to providing traction, sole structure 130 may attenuate ground reaction forces when compressed between the foot and the ground during walking, running, pushing, or other ambulatory activities. The configuration of sole structure 130 may vary significantly in different embodiments to include a variety of conventional or non-conventional structures. In some cases, the configuration of sole structure 130 can be configured according to one or more types of surfaces on which sole structure 130 may be used. Examples of surfaces include, but are not limited to, natural turf, synthetic turf, dirt, hardwood flooring, skims, wood, plates, footboards, boat ramps, as well as other surfaces.

Sole structure 130 is secured to upper 102 and extends between the foot and the ground when article 100 is worn. In different embodiments, sole structure 130 may include different components. For example, sole structure 130 may include an outsole, a midsole, and/or an insole. In some cases, one or more of these components may be optional.

Furthermore, upper 102 may generally incorporate various provisions associated with uppers. In different embodiments, upper 102 may be configured to provide cushioning, tension, ventilation, shock absorption, energy return, support, as well as possibly other provisions.

Upper 102 may also be characterized by an exterior surface 112, which is an outer or exposed surface. In addition, upper 102 may include an interior surface 110 that is opposite exterior surface 112. Interior surface 110 may also define interior cavity 106 in some embodiments. Furthermore, in some embodiments, upper 102 includes a mouth 114 that provides entry for the foot into interior cavity 106 of upper 102. Furthermore, mouth 114 may be at least in part defined by a collar 128 that extends around the perimeter of the opening associated with mouth 114. Collar 128 may be understood to include the perimeter defined by the edges of mouth 114 as bounded by heel region 14 of upper 102, as well as a rear edge 138 of a tongue 122.

In addition, the area associated with collar 128 and/or tongue 122 can also be seen to include one or more borders 140. Borders 140 may also be disposed around a shield 132 (discussed below) in some embodiments. Borders 140 can be similar to a trim in different embodiments, framing or otherwise bordering the edges of various portions of upper 102. Borders 140 may allow a user to more easily hold and/or maintain a grip on portions of upper 102, as well as provide an aesthetically pleasing accent (design) in some embodiments.

Referring to FIGS. 1 and 2, in some embodiments, article 100 includes provisions for helping to secure or fasten upper 102 and sole structure 130 to a foot. In some embodiments, article 100 includes a fastening system 120. In different embodiments, fastening system 120 could incorporate various fastening provisions including laces, tensile elements, straps, zippers, or other kinds of fasteners that may help secure upper 102 around a foot. In some cases, fastening system 120 may include one or more fasteners 108. In one case fasteners 108 may comprise an elongated strap-like component that may be wrapped around a portion of upper 102.

In the embodiment of FIGS. 1 and 2, fasteners 108 include a first fastener 124 and a second fastener 126. First fastener 124 can be seen to be disposed closer to forefoot portion 10 than second fastener 126. Furthermore, as shown in FIG. 1, in one embodiment, one or more fasteners 108 may include a clasp 142. Clasp 142 may be a component joined to an end of fasteners 108 to allow users to clip, buckle, or otherwise securely attach fasteners 108 to another component (the component may be independent from article 100, such as a portion of a vessel). Clasp 142 may also be a component that facilitates the adjustment of fasteners 108 by providing a grip for a user to pull or move fasteners 108.

As shown in the isometric medial view of FIG. 2, fasteners 108 may contact one or more receptacles 166. Receptacles 166 may be buckles, loops, rings, or other elements for providing a point of anchor or attachment to a portion of a fastener. Receptacles 166 may be made of any material, including textiles, or more rigid materials such as plastic or a metal material. In one embodiment, receptacles 166 may comprise an overall rectangular shape or other shapes with a central aperture that receives portions of fasteners 108.

In FIG. 2, first fastener 124 is disposed over instep portion 13 of upper 102, and extends through a first receptacle 144. Similarly, in one embodiment, second fastener 126 may also extend through a second receptacle 146. In some embodiments, fasteners 108 may loop or fold over an upper region 180 of receptacles 166, forming a looping section 198.

In some embodiments, receptacles 166 may be further joined or linked to another element of fastening system 120. For example, in FIG. 2, a pair of fixed straps 148 is depicted. Fixed straps 148 may also contact receptacles 166 in some embodiments. In some cases, fixed straps 148 may be disposed along one side of upper 102, near sole structure 130. Fixed straps 148 may provide greater reinforcement to fastening system 120. Further, fixed straps 148 can act as an anchoring device for fastening system 120 in some embodiments.

In FIG. 2, fixed straps 148 include a first fixed strap 150 and a second fixed strap 152. As shown in FIG. 2, fixed straps 148 may be joined to article 100, and form a loop around a lower region 178 of receptacles 166. For example, first fixed strap 150 includes a first portion 170 and a second portion 172, where first portion 170 extends upward, loops through lower region 178 of first receptacle 144 along a first folded region 182, and transitions into second portion 172, which extends downward toward sole structure 130. Similarly, second fixed strap 152 includes a first portion 174 and a second portion 176, where first portion 174 extends upward, loops through lower region 178 of second receptacle 146 along a second folded region 184, and transitions into second portion 176, extending downward toward sole structure 130. Thus, in one embodiment, fixed straps 148 can form a kind of eyestay for receptacles 166.

In some embodiments, fixed straps 148 may be joined to exterior surface 112 of upper 102 and/or to receptacles 166 by one or more anchor portions 168. In FIG. 2, first fixed strap 150 is joined to upper 102 along a first anchor portion 154 and a second anchor portion 156. Similarly, second fixed strap 152 is joined to upper 102 along a fourth anchor portion 160 and a fifth anchor portion 162. In cases where fixed straps 148 are looped around receptacles 166, there may be additional anchor portions 168. As shown in FIG. 2, a third anchor portion 158 joins first portion 170 and second portion 172 of first fixed strap 150, forming a kind of tunnel or tube for containing or enclosing a part of lower region 178 of first receptacle 144. Furthermore, a sixth anchor portion 164 can join first portion 174 and second portion 176 of second fixed strap 152 in a similar manner.

Thus, in various embodiments, anchor portions 168 can comprise regions where a component or portion of article 100 is joined or otherwise secured. For example, first fixed strap 150 may be attached to upper 102 or to itself. The attachment may be formed through sewing, stitching, fusion, bonding, glue (by an adhesive or other agents), or a combination of thereof. In some cases, anchor portions 168 can provide a high level of strength and stability, and/or can also be used to provide design or ornamental enhancements to article 100. In FIG. 2, for example, anchor portions 168 comprise a stitched box pattern. In one embodiment, anchor portions 168 may be reinforced with a stitched "X", a zigzag pattern, or other types of stitching through the middle region of the stitch box. The operation of fastening system 120 will be discussed further in reference to FIGS. 4-9 below.

Again referring to FIGS. 1 and 2, in some embodiments, upper 102 may include provisions that provide cushioning and support across the instep of the foot. Such provisions may also allow article 100 to be more adjustable for a user, and facilitate the removal and entry of a foot into article 100. As shown in FIGS. 1-3, in one embodiment, tongue 122 is disposed on or is adjacent to the top part of the foot when article 100 is worn by a user. One purpose of tongue 122 may be to protect the top of the foot. In other cases, tongue 122 may help keep various fastening elements from rubbing or otherwise discomforting the foot. Tongue 122 may also serve a decorative purpose in some embodiments.

In different embodiments, the geometry of tongue 122 could vary. In some embodiments, tongue 122 may comprise a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of tongue 122 could vary and could include various contours or features associated with parts of a foot, for example, the instep region of a foot. It should also be understood that in some embodiments, tongue 122 may be disposed or joined to upper 102 in an asymmetrical manner. In other words, tongue 122 may be joined along at least one edge to upper 102, but remain unanchored or unattached along another edge. Tongue 122 will be discussed further with respect to FIGS. 10 and 11.

Furthermore, as shown in FIGS. 1 and 2, embodiments of article 100 may include a shield 132. In embodiments that include tongue 122, shield 132 may be disposed over or be otherwise adjacent to tongue 122. In different embodiments, the geometry of shield 132 could vary. In some embodiments, similar to tongue 122, shield 132 may comprise a substantially flat or two-dimensional material or structure. In other embodiments, the geometry of shield 132 could vary and could include various contours or features associated with parts of a foot, for example, the vamp region or instep region of a foot. In various embodiments, shield 132 may also include fluid-filled chambers, padding, plates, moderators, or other elements that further attenuate forces, enhance stability, provide cushioning or protection, or influence the motions of the foot, for example. Furthermore, in some embodiments, shield 132 may include bumps or other irregular portions associated with padded regions. Shield 132 will be discussed further with respect to FIGS. 9, 15, and 16.

In addition, in some embodiments, article 100 can include provisions for drainage, breathability, quick drying, and/or ventilation. In one embodiment, upper 102 can include sections made of waterproof materials and/or other sections made of air permeable materials that allow for interior cavity 106 to breathe or ventilate. For example, upper 102 may include one or more ventilation portions. In some embodiments, the ventilation portions could be mesh portions formed from any kinds of textile materials.

Figure 11:
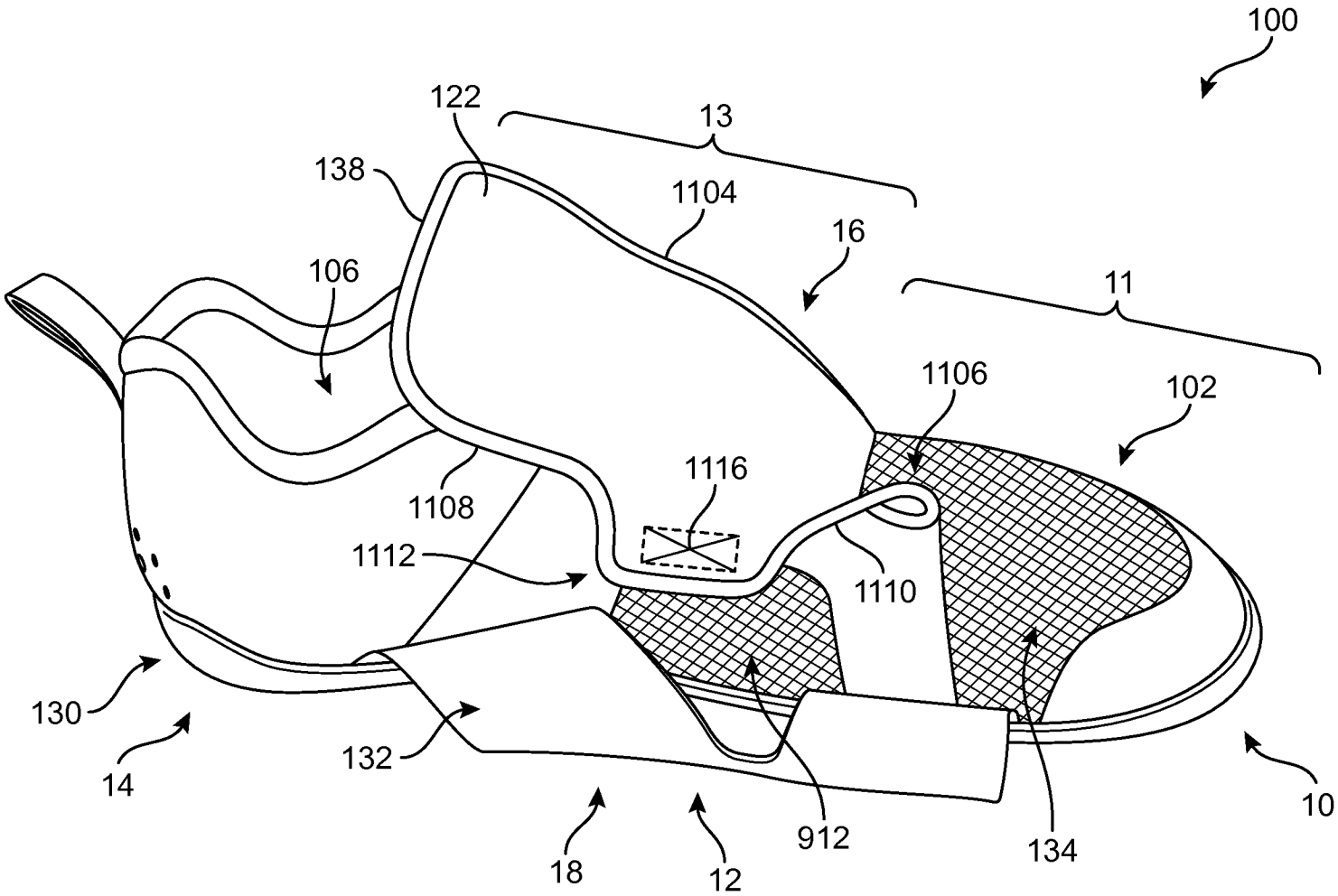
FIG. 11 is a schematic isometric view of an embodiment of an article of footwear including an upper with a tongue and a sole structure.

The ventilation portions may vary in size and location. In FIG. 1, a first ventilation portion 134 and a second ventilation portion 136 are depicted. First ventilation portion 134 covers a substantial majority of forefoot portion 10. In the embodiment of FIG. 1, first ventilation portion 134 extends along vamp portion 11. Some parts of first ventilation portion 134 may extend to the outer edges of upper 102 toward lateral side 16 and medial side 18, as seen in FIGS. 1 and 2. In one embodiment, first ventilation portion 134 may also extend to a portion of tongue 122 (as shown in FIG. 11).

In some embodiments, ventilation portions can provide support to a user's foot, as well as breathability. Furthermore, in activities associated with the water, ventilation portions can allow water to easily drain from interior cavity 106. Additional provisions directed to ventilation can be seen in FIG. 3, where a rearward view of article 100 is depicted. In some embodiments, different portions of upper 102 may include one or more apertures 186. Apertures 186 may comprise holes or openings within upper 102. In different cases, apertures 186 may vary in geometry and include round, square, regular, and/or irregular shapes. Furthermore, apertures 186 may vary in size, depending on the degree of ventilation or drainage desired. In FIG. 3, apertures 186 include a first aperture 192 and a second aperture 194, where second aperture 194 is smaller than first aperture 192. In one embodiment, heel portion 14 of upper 102 can include multiple sets of apertures. For example, in FIG. 3, apertures 186 include a first set of apertures 188 and a second set of apertures 190. First set of apertures 188 can be substantially similar to second set of apertures 190 in some embodiments. In some cases, first set of apertures 188 may be arranged in a mirrored configuration relative to second set of apertures 190. In other embodiments, the different sets of apertures may differ in size, number, shape, and/or arrangement.

In some embodiments, upper 102 may include provisions for easy carry or storage of article 100, and/or provisions for facilitating the removal of article 100. As shown in FIG. 3, first set of apertures 188 is separated from second set of apertures 190 by a looped strap 196 disposed along a back seam of heel portion 14. The back seam may be disposed adjacent to a rearmost portion 300 of heel portion 14 in some embodiments. In some embodiments, a user may insert at least one finger into looped strap 196 to carry and/or pull article 100 away from his or her foot. Other embodiments may include different configurations providing similar functions.

Different parts and components of upper 102 may be formed from a variety of different materials. Exemplary materials that could be used in various embodiments include, but are not limited to, expanded rubber, foam rubber, polymers, various kinds of foams, polyester, thermoplastics, polyurethane, nylon, Gore-Tex® or polytetrafluoroethylene (PTFE), leather, plastic, textiles, as well as possibly other materials. For example, in one embodiment, a tongue may be formed from a material that resists water. In another embodiment, portions of a shield could be formed from a polymer foam material (i.e., provides cushioning). Other parts of upper 102 may be made from any of a plurality of materials or combination of materials, such as leather, leather-like materials, polymer materials, plastic materials, and textile fabrics and materials.

As described above, article 100 may include provisions for securing the foot into article 100. Fastening system 120 may be designed to help secure the foot onto the appropriate cleat or securement position (see FIG. 14) and support the foot's structure in some embodiments. Referring to FIGS. 4-9, a sequence of figures depicting the use of an embodiment of a fastening system is shown. Fastening system 120 and/or upper 102 may include a secured state, where fasteners 108 are closed and tightened. In the secured state, as described further below with respect to FIGS. 14 and 15, one or more fasteners 108 may exert a compressive force along instep portion 13. In addition, in one embodiment, upper 102 may be in the secured state when tongue 122 is disposed to extend over instep portion 13, shield 132 is disposed adjacent to and extends over tongue 122, and fastening system 120 is engaged. Furthermore, fastening system 120 and/or upper 102 may include an open state, where fasteners 108 have been loosened, and various components (e.g., tongue 122 and/or shield 132) are free to move in different directions. In one embodiment, upper 102 may be in the open state when fastening system 120 is loosened, shield 132 is swiveled, rotated, turned, or bent toward medial side 18, and a lateral edge of tongue 122 is pulled away from an inner lateral edge of instep portion 13, as will be discussed further below. In some embodiments, a user may adjust fasteners 108 to secure a foot in article 100 and transition article 100 from the open state to the secured state, or transition article 100 from the secured state to the open state.

Figure 4:
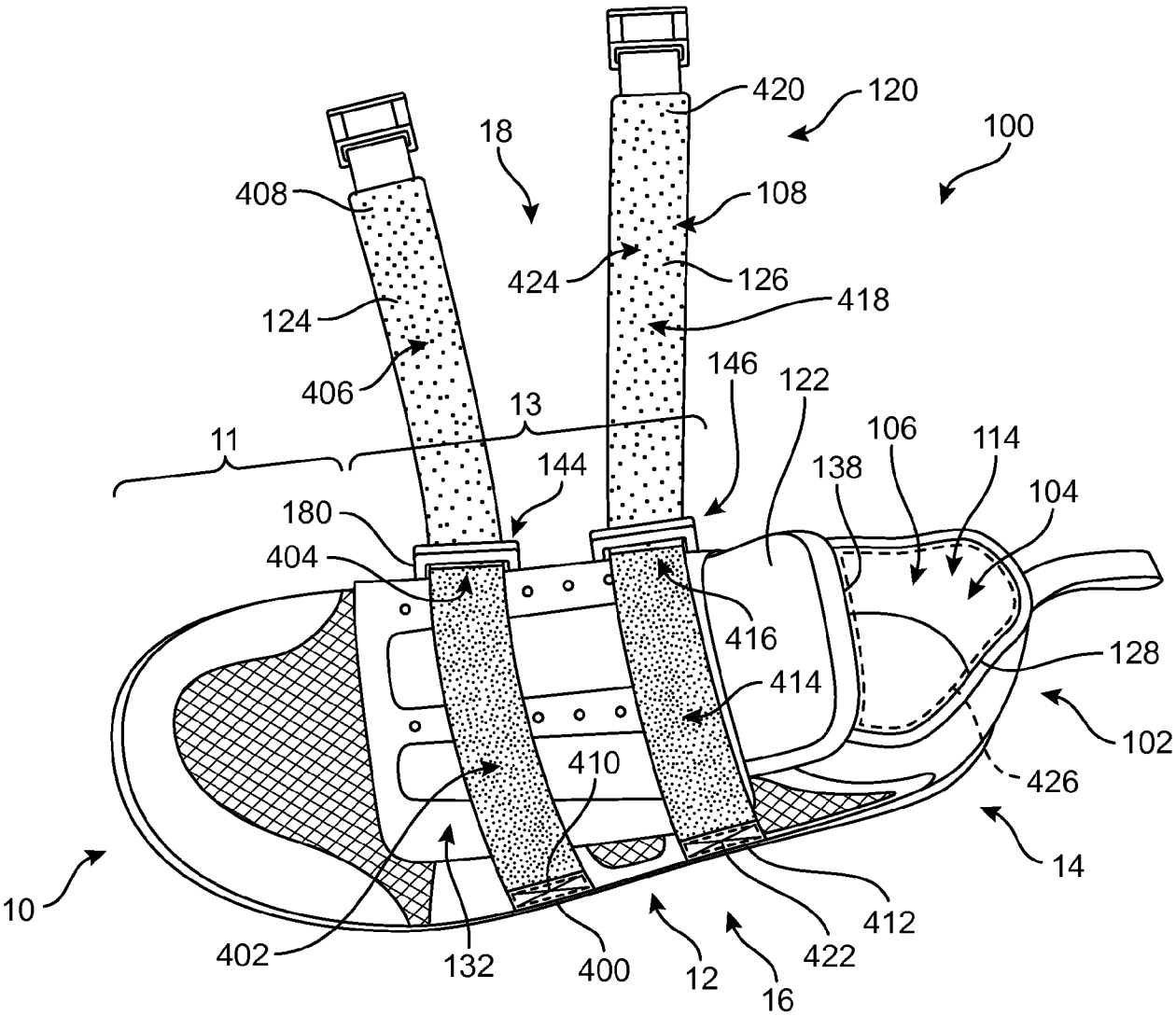
FIG. 4 is a schematic isometric view of an embodiment of an article of footwear including a fastening system.
Figure 5:
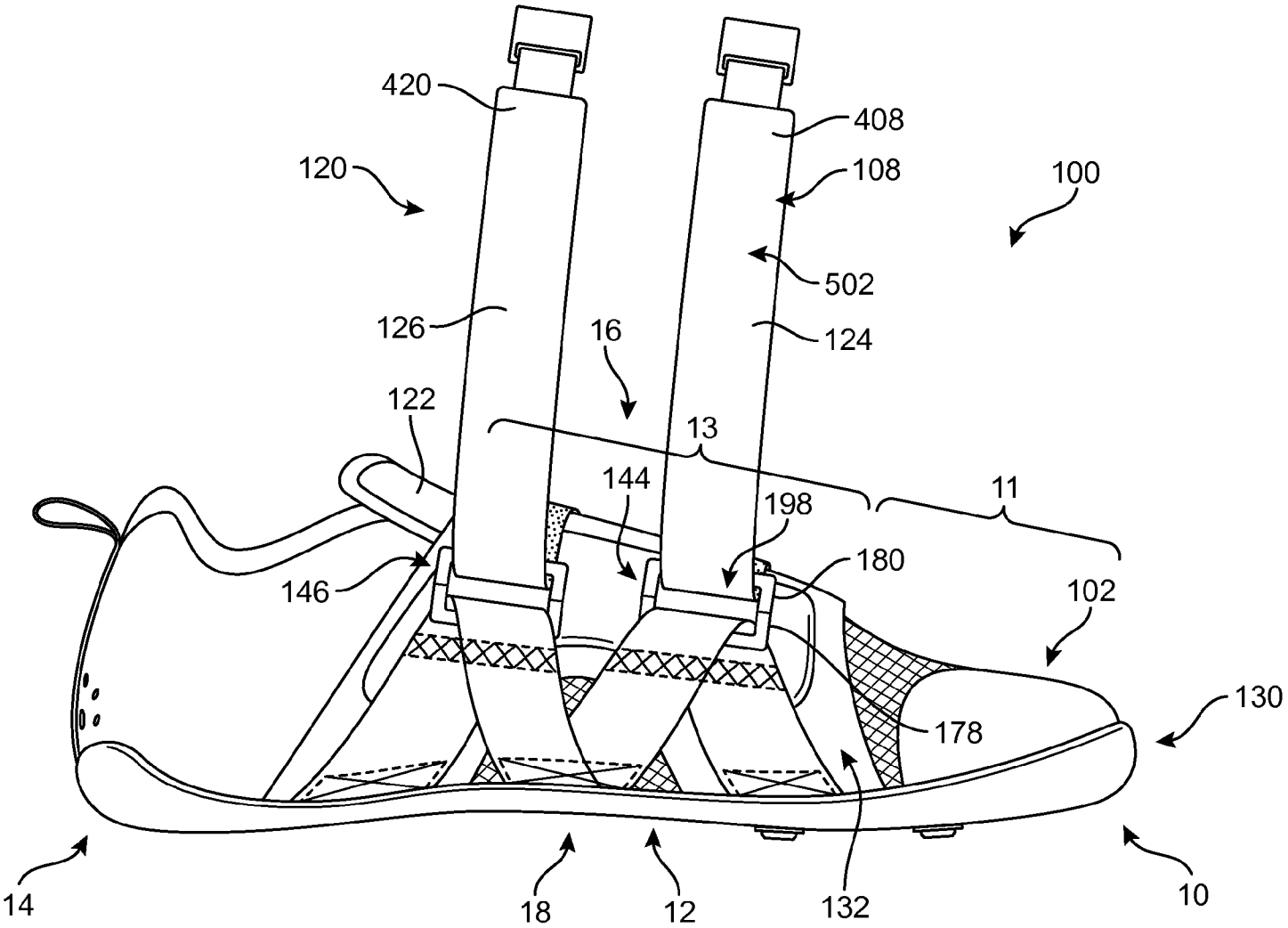
FIG. 5 is a schematic isometric view of an embodiment of an article of footwear including a fastening system.

In FIG. 4, a lateral isometric view of article 100 is shown, and in FIG. 5, a medial isometric view of article 100 is shown. In FIGS. 4 and 5, a portion of first fastener 124 and a portion of second fastener 126 have been moved and raised. A portion of each fastener can be seen to extend in a substantially vertical direction. For purposes of reference, first fastener 124 may be divided into a first secured end 400, a first hook portion 402, a first loop portion 406, and a first free end 408. First loop portion 406 may be demarcated from first hook portion 402 along a first transition region 404. Similarly, second fastener 126 may be divided into a second secured end 412, a second hook portion 414, a second loop portion 418, and a second free end 420. Second loop portion 418 may be demarcated from second hook portion 414 along a second transition region 416. Thus, hook portions and loop portions may be integrally formed together in some embodiments.

In some embodiments, different portions of fasteners 108 may be joined along either medial side 18 or lateral side 16 of upper 102. In the embodiment disclosed herein, first secured end 400 and second secured end 412 are joined to upper 102 along lateral side 16 (which may correspond to the outboard side of a vessel). As discussed above with respect to anchor portions 168 in FIG. 2, first secured end 400 may be fixed or otherwise attached to upper 102 by a seventh anchor portion 410, and second secured end 412 may be fixed or otherwise attached to upper 102 by an eighth anchor portion 422.

Furthermore, fasteners 108 can include an inner side 424 (shown in FIG. 4) and an opposing outer side 502 (shown in FIG. 5). In some embodiments, first hook portion 402 can include a first material of hook fastening materials along inner side 424, and first loop portion 406 can include a second material of loop fastening materials along inner side 424. It should be understood that in other embodiments, the positions of first loop portion 406 and first hook portion 402 may be exchanged such that first loop portion 406 is disposed below, and first hook portion 402 is disposed above, when first fastener 124 is in its closed (secured) configuration. It should also be understood that any discussion herein pertaining to first fastener 124 may also apply to second fastener 126.

The first material along inner side 424 and the second material of outer side 502 of fasteners 108 can be made of various materials, including Teflon loops, polyester hooks, VELCRO® or hook-and-loop fasteners, glass backing, and other touch fasteners. In one embodiment, the bond formed between the hook and loop materials can provide additional strength to fastening system 120 because the pulling forces can be spread evenly across all hooks. Outer side 502 of fasteners 108 may comprise a variety of different materials, as discussed above with reference to materials comprising upper 102.

In some embodiments, fasteners 108 can vary in length and width. Fasteners 108 may be longer or shorter than those depicted herein. In one embodiment, first fastener 124 has a length that is greater than the length of second fastener 126. In other embodiments, second fastener 126 may be longer than first fastener 124, or second fastener 126 may be substantially similar in length to first fastener 124. As the size of a foot typically becomes larger in the direction extending from the toes toward the heel, it may be useful to include fasteners 108 of varying lengths across the foot for function and comfort. In addition, first fastener 124 may have a width that is substantially similar to the width of second fastener 126. However, in other embodiments, the width of first fastener 124 may vary with respect to the width of second fastener 126, such that first fastener 124 is wider or narrower than second fastener 126. Further, it should be understood that while the embodiments depicted herein show first fastener 124 as having a substantially constant width, in other embodiments, the width may be irregular along the length of first fastener 124.

First fastener 124 can be fed through and extend through first receptacle 144, such that looping section 198 contacts upper region 180 of first receptacle 144. The specific portion of first fastener 124 associated with looping section 198 can vary, depending on the extent to which fastening system 120 is tightened or loosened. As a result of the hook and fastening materials mentioned above, when first free end 408 of first fastener 124 is pulled from one side of article 100 toward the other side of article 100, each side (i.e., lateral side 16 and medial side 18) may be compressed and/or drawn toward the other. Once first hook portion 402 comes into contact with first loop portion 406, the first and second materials of the loop and hook fastener materials can engage, allowing a tightening and/or securement of first fastener 124, as shown in the tightened configuration of fastening system 120 in FIGS. 1-2.

Figure 6:
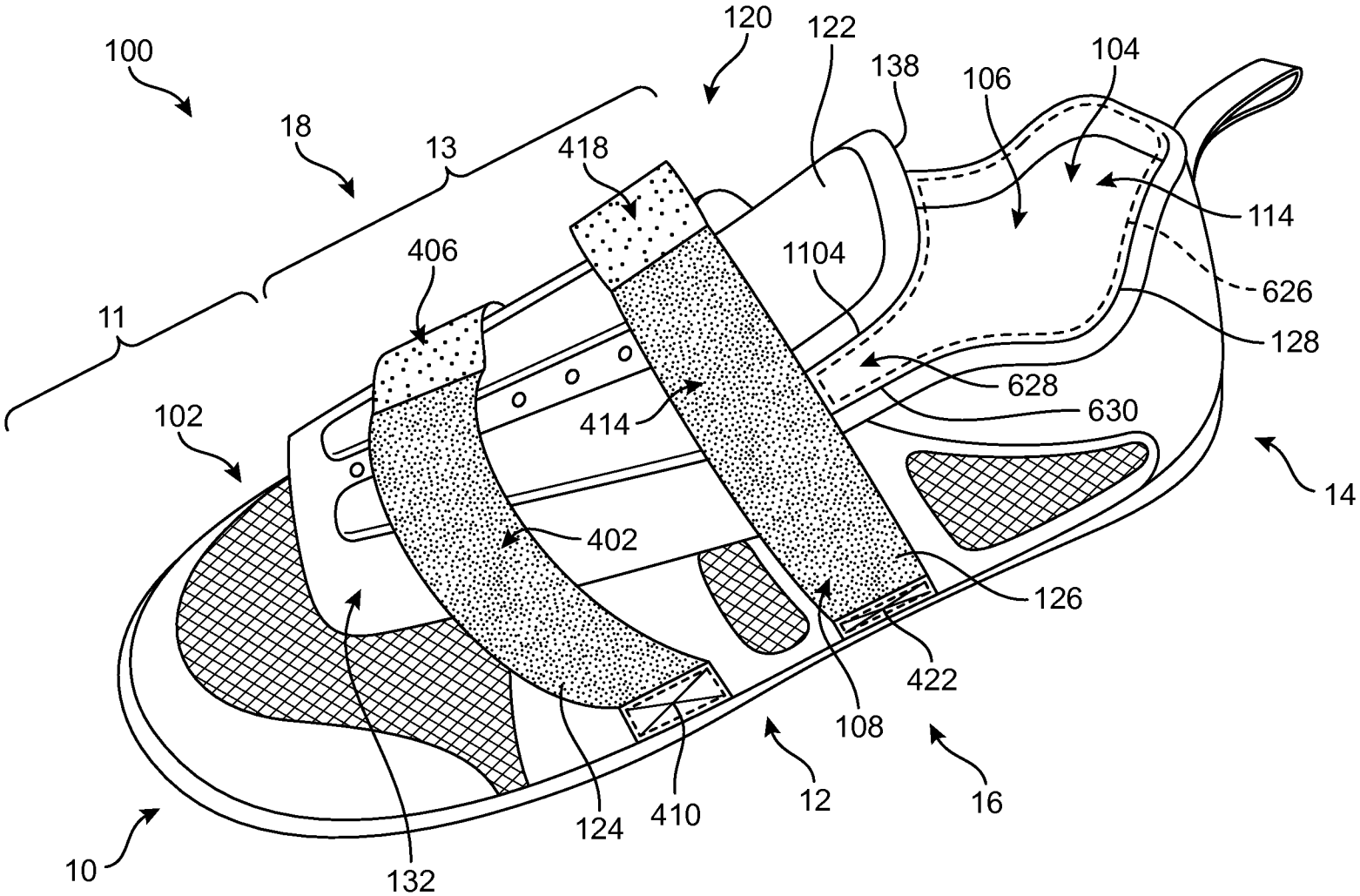
FIG. 6 is a schematic isometric view of an embodiment of an article of footwear including a fastening system.
Figure 7:
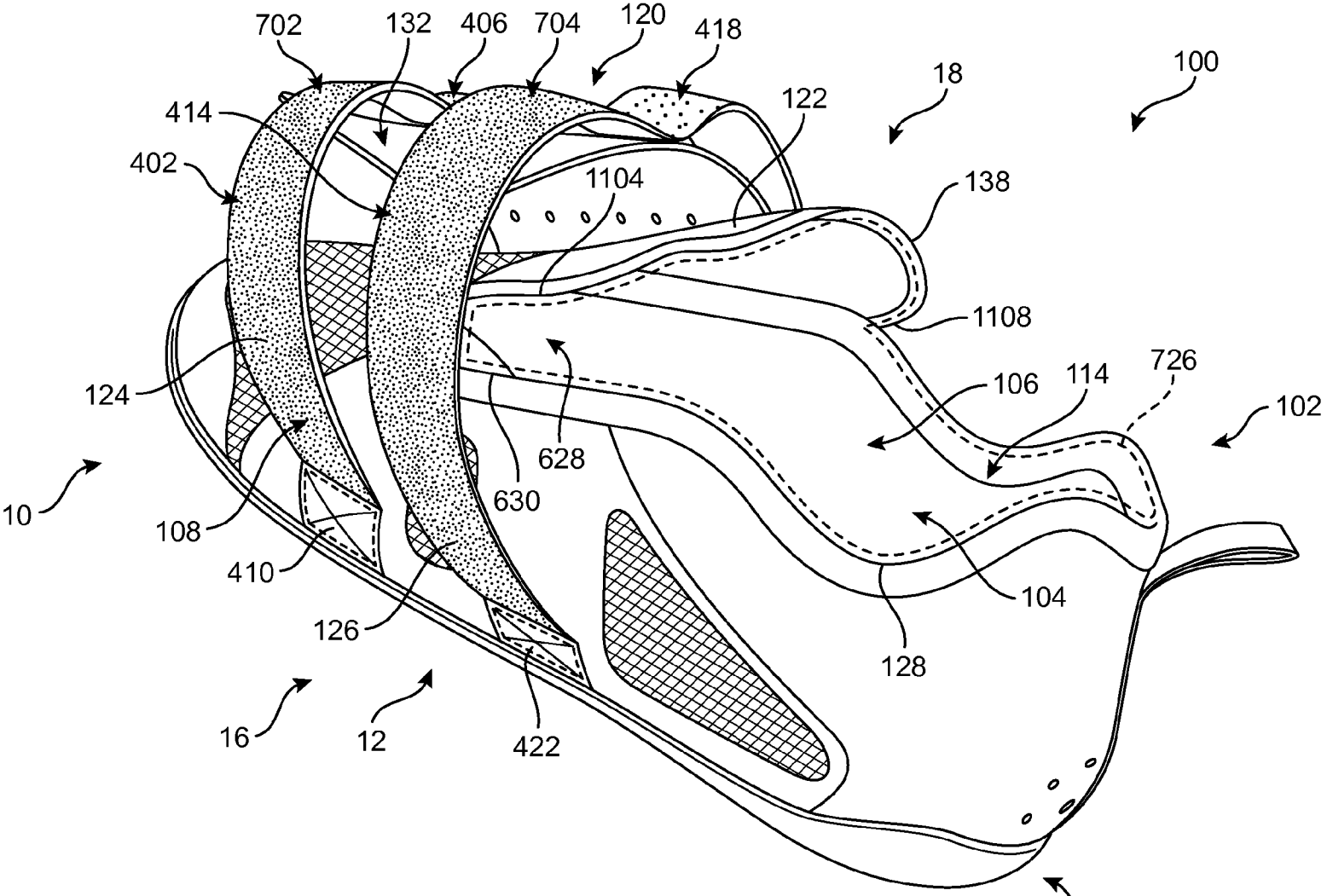
FIG. 7 is a schematic isometric view of an embodiment of an article of footwear including a fastening system.
Figure 8:
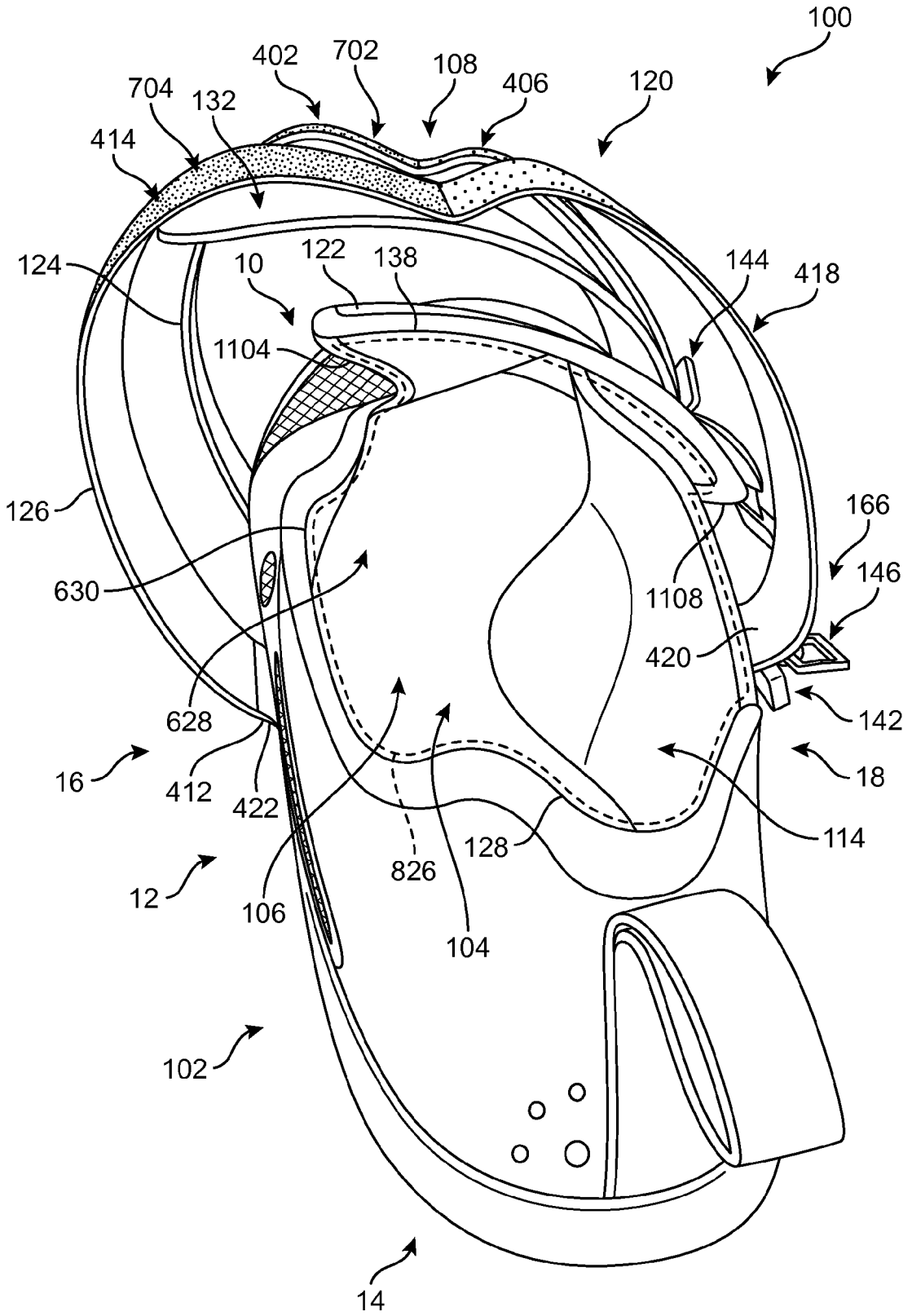
FIG. 8 is a schematic isometric view of an embodiment of an article of footwear including a fastening system.

In addition, as shown in FIGS. 6-8, article 100 can include provisions for further loosening fasteners 108 in fastening system 120. In FIG. 6, a lateral view of fasteners 108 is shown. First fastener 124 is depicted such that it extends from seventh anchor portion 410 along lateral side 16, over instep portion 13, and along medial side 18 of upper 102. In some embodiments, the increased loosening of fasteners 108 may form a first curved arch 702 and a second curved arch 704 over the instep portion, comprising varying contours, as shown in FIG. 7. For example, first curved arch 702 may include a portion of first fastener 124 as it extends between seventh anchor portion 410 (shown in FIG. 8) and first receptacle 144. Depending on the extent that first fastener 124 is loosened, the length of first curved arch 702 can vary. Similarly, second curved arch 704 may include a portion of second fastener 126 as it extends between eighth anchor portion 422 and second receptacle 146 (shown in FIG. 8). In some embodiments, as fasteners 108 are loosened, shield 132 and/or tongue 122 may also become more adjustable, and form an opening that is larger, as will be discussed further below.

In FIG. 8, fasteners 108 have been further loosened, such that the portions of fasteners 108 comprising first curved arch 702 and second curved arch 704 have each been lengthened. However, it should be understood that, in different embodiments, first fastener 124 may be loosened to a greater (or lesser) extent than second fastener 126. As shown in FIG. 8, second curved arch 704 comprises substantially the full length of second fastener 126. In other words, second curved arch 704 begins with second secured end 412 along eighth anchor portion 422, and extends across and over the instep portion to second receptacle 146, which contacts second free end 420, and is substantially close to its clasp 142. In one embodiment, this may represent the maximum loosening extent of fastening system 120 while fasteners 108 still pass through the receptacles.

Figure 9:
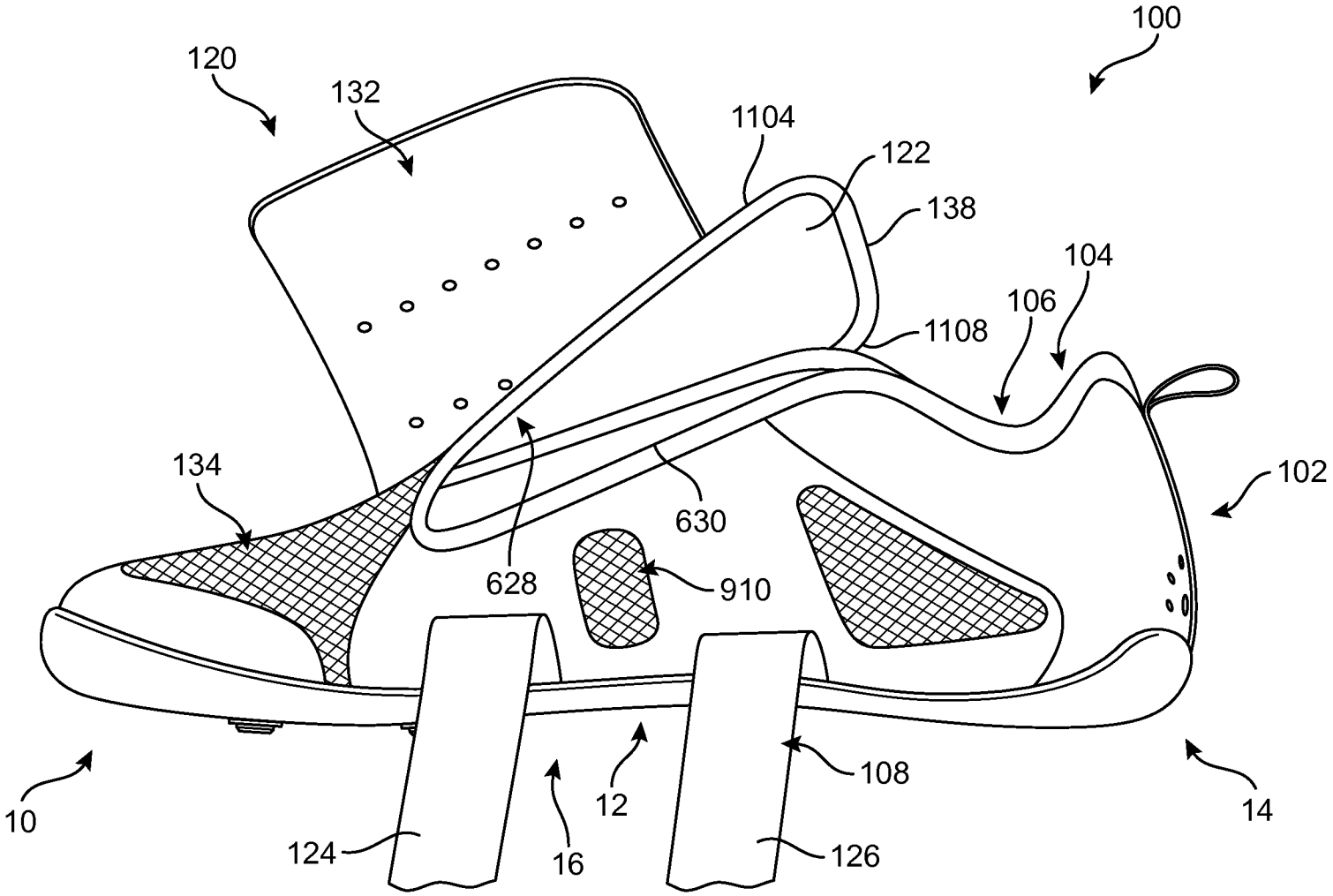
FIG. 9 is a schematic isometric view of an embodiment of an article of footwear including an upper with a shield.

However, it should be understood that fasteners 108 may be removed or separated from receptacles 166 in different embodiments. This can allow some dimensions of article 100 to be further adjusted or widened. For example, in FIG. 9, a lateral isometric view of article 100 is shown where fasteners 108 have been separated from receptacles 166 (shown in FIG. 8). Thus, in some embodiments, fasteners 108 can be been pulled back toward lateral side 16, such that they extend beyond upper 102. For purposes of convenience, only a portion of fasteners 108 is depicted in FIG. 9. However, it should be understood that the figures are for purposes of illustration only, and each of the components described above with respect to FIGS. 1-3 may be included or referred to in the description while not fully illustrated in the figures.

Figure 10:
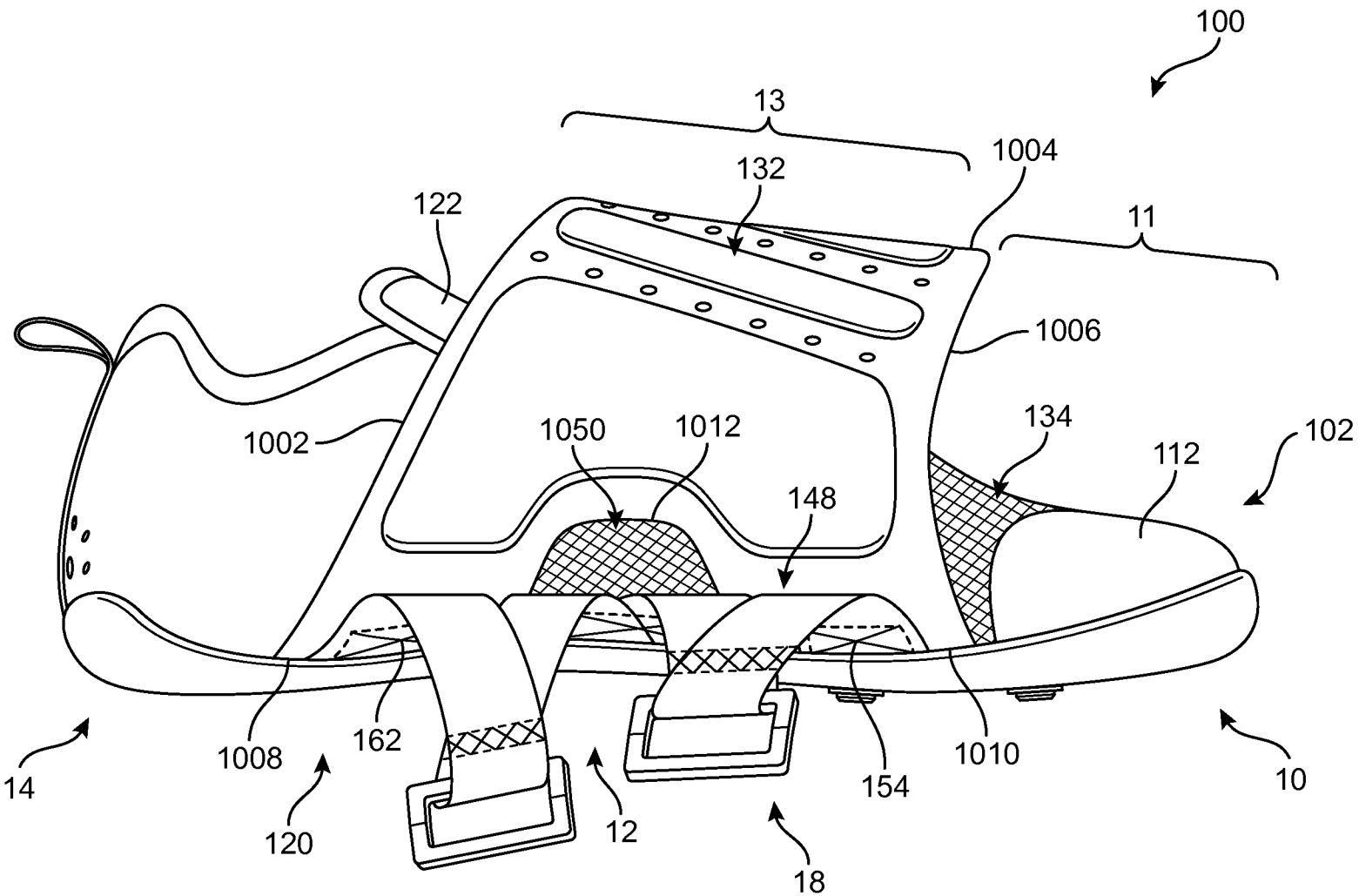
FIG. 10 is a schematic isometric view of an embodiment of an article of footwear including a fastening system, a shield, and a tongue.

FIG. 10 provides a medial isometric view of article 100, where fasteners 108 have been removed from exterior surface 112 of upper 102. Shield 132 may be attached to or be associated with instep portion 13 of upper 102 in some embodiments. As shown in the embodiments of FIGS. 1-8, shield 132 is generally disposed beneath fasteners 108 in the closed configurations of fastening system 120.

Shield 132 may include different edges in some embodiments. As shown in FIG. 10, for purposes of reference, the outer perimeter of shield 132 may be divided into a rear edge 1002, a lateral edge 1004, a forward edge 1006, a first medial edge 1008, a second medial edge 1010, and a medial curved edge 1012. In one embodiment, the shape of shield 132 may resemble a generally oblong rectangular or trapezoidal shape joined to an arch. In other embodiments, the perimeter and shape of shield 132 may vary from what is depicted here, and include any regular or irregular shape.

Shield 132 may be joined to upper 102 in various ways. In some embodiments, shield 132 may be joined along multiple edges to upper 102. In other cases, shield 132 may be joined to upper 102 along every side of shield 132 to form a fully integrated structure. In other embodiments, shield 132 may be joined along only one side to upper 102. For example, as shown in FIG. 10, first medial edge 1008 and second medial edge 1010 are attached to upper 102. First medial edge 1008 is joined to upper 102 at fifth anchor portion 162, and second medial edge 1010 is joined to upper 102 at first anchor portion 154. In other words, shield 132 is joined to upper 102 along substantially the same regions as portions of fixed straps 148. In some embodiments, the same stitching that joins fixed straps 148 to upper 102 may join shield 132 to upper 102. Thus, shield 132 may be "sandwiched" or otherwise disposed between fixed straps 148 and upper 102 in one embodiment.

Furthermore, article 100 may include provisions for adjustment and movement of shield 132 in some embodiments. For example, first anchor portion 154 and fifth anchor portion 162 may act as hinge points, which bind one side of shield 132 to a portion of upper 102. In one embodiment, shield 132 may be rotated, pivoted, swiveled, swung, or otherwise moved back and forth along the hinge points associated with the anchor portions. In another embodiment, shield 132 may be turned in a manner similar to a page that is bound to the spine of a book. The degree of rotation permitted to shield 132 may vary in different embodiments. In some cases, the anchor portions may be configured to allow rotation of over 180 degrees. In other cases, rotation may be limited to less than 180 degrees, or be substantially close to 90 degrees.

The materials comprising shield 132 may also affect the ability of shield 132 to be adjusted, or moved. Thus, in some embodiments, shield 132 may include substantially flexible materials, allowing shield 132 to be bent or curved back, giving the user more easy access to tongue 122, for example. In other embodiments, shield 132 may include substantially rigid materials that inhibit the bending of shield 132 and increase the amount of resistance of shield 132 to deformation. In another embodiment, shield 132 may include areas that are more flexible and areas that are more rigid. Additional features of shield 132 will be discussed further with respect to FIGS. 15 and 16.

In addition, referring to FIGS. 9 and 10, a third ventilation portion 910 and a fourth ventilation portion 1050 can be seen, located on opposite sides of article 100. Third ventilation portion 910 is disposed along a portion of lateral side 16 of article 100, between first fastener 124 and second fastener 126, and fourth ventilation portion 1050 is disposed along a portion of medial side 18, between first anchor portion 154 and fifth anchor portion 162. Similar to first ventilation portion 134 and second ventilation portion 136 identified in FIG. 1, third ventilation portion 910 and fourth ventilation portion 1050 may provide article 100 with greater drainage, breathability, quick drying, and/or ventilation, as described with respect to ventilation portions and apertures above.

As described above, upper 102 may also be attached to tongue 122. Tongue 122 may help keep various fastening elements from rubbing or otherwise discomforting the foot. In addition, tongue 122 may allow interior cavity 106 to better conform to the shape of a foot, add comfort, and secure and stabilize a foot within article 100.

In FIG. 11, shield 132 has been raised from its closed configuration, and then bent along its anchor portions toward sole structure 130, exposing tongue 122. A portion of tongue 122 may be attached to or associated with instep portion 13 of upper 102 in some embodiments. As shown in the embodiments of FIGS. 1-8, tongue 122 is generally disposed beneath shield 132 in the closed configurations of fastening system 120. However, in other embodiments, tongue 122 may be disposed away from, or above, shield 132. In another embodiment, there may be no shield 132, and tongue 122 may be disposed directly beneath fasteners 108.

In different embodiments, the dimensions of tongue 122 could vary. In some embodiments, tongue 122 has a length that generally extends over the region of upper 102 associated with instep portion 13 and a part of heel portion 14. In another embodiment, tongue 122 could have a length less than or substantially greater than the length of instep portion 13. In some cases, tongue 122 may vary in width. Furthermore, in one embodiment, tongue 122 has a maximum width that is less than the maximum width of shield 132. Thus, in some embodiments, a majority of the area of tongue 122 may be covered by shield 132 in the closed configuration, creating an overlapping area where both tongue 122 and shield 132 occur over upper 102. In other embodiments, tongue 122 may be wider or narrower than shield 132. In some embodiments, tongue 122 may have a width approximately equal to a width of upper 102 or the width of shield 132.

Furthermore, tongue 122 may include different edges in some embodiments. For purposes of reference, the outer perimeter of tongue 122 may be divided into rear edge 138, a lateral edge 1104, a forward portion 1106, a first medial edge 1108, a second medial edge 1110, and a medial tab portion 1112 (as shown in FIG. 11). It should be understood that in other embodiments, tongue 122 may be formed or joined differently than shown in FIGS. 1-13. Another example of tongue 122 will be discussed with reference to FIGS. 17 and 18 below.

In different embodiments, the shape of tongue 122 may vary. In one embodiment, the shape of tongue 122 may resemble a generally oblong rectangular or trapezoidal shape connected to a small flap associated with medial tab portion 1112. In other embodiments, the perimeter and shape of tongue 122 may vary from what is depicted here, and include any regular or irregular shape.

Tongue 122 may be joined to upper 102 in various ways. In some embodiments, tongue 122 may be joined along multiple edges to upper 102. In other cases, tongue 122 may be joined to upper 102 along three or more edges of tongue 122 to form an integrated structure. In other embodiments, tongue 122 may be joined along only one or two sides to upper 102. As shown in FIG. 11, in some embodiments, forward portion 1106 of tongue 122 is joined to upper 102 near vamp portion 11. Furthermore, in one embodiment, forward portion 1106 may be integrally joined to vamp portion 11, forming a continuous region. In other embodiments, forward portion 1106 may be joined in a manner described previously with respect to anchor portions above.

Generally, if the tongue of an article of footwear slips or moves too far over toward one side of the article, the article may be uncomfortable for the user. Thus, in some embodiments, article 100 can include provisions for further securing a tongue to the upper. For example, there may be an additional securing portion along upper 102 that can join with another portion of tongue 122 and help secure tongue 122 against excessive or uncomfortable sliding or movement over a foot. As shown in FIG. 11, medial tab portion 1112 is joined to upper 102 along a ninth anchor portion 1116. In one embodiment, ninth anchor portion 1116 can also connect tongue 122 to at least a portion of fourth ventilation portion 1050 (shown in FIG. 10) in upper 102. Such an arrangement also provides the advantage of maintaining tongue 122 in an optimum center position, if desired.

Figure 12:
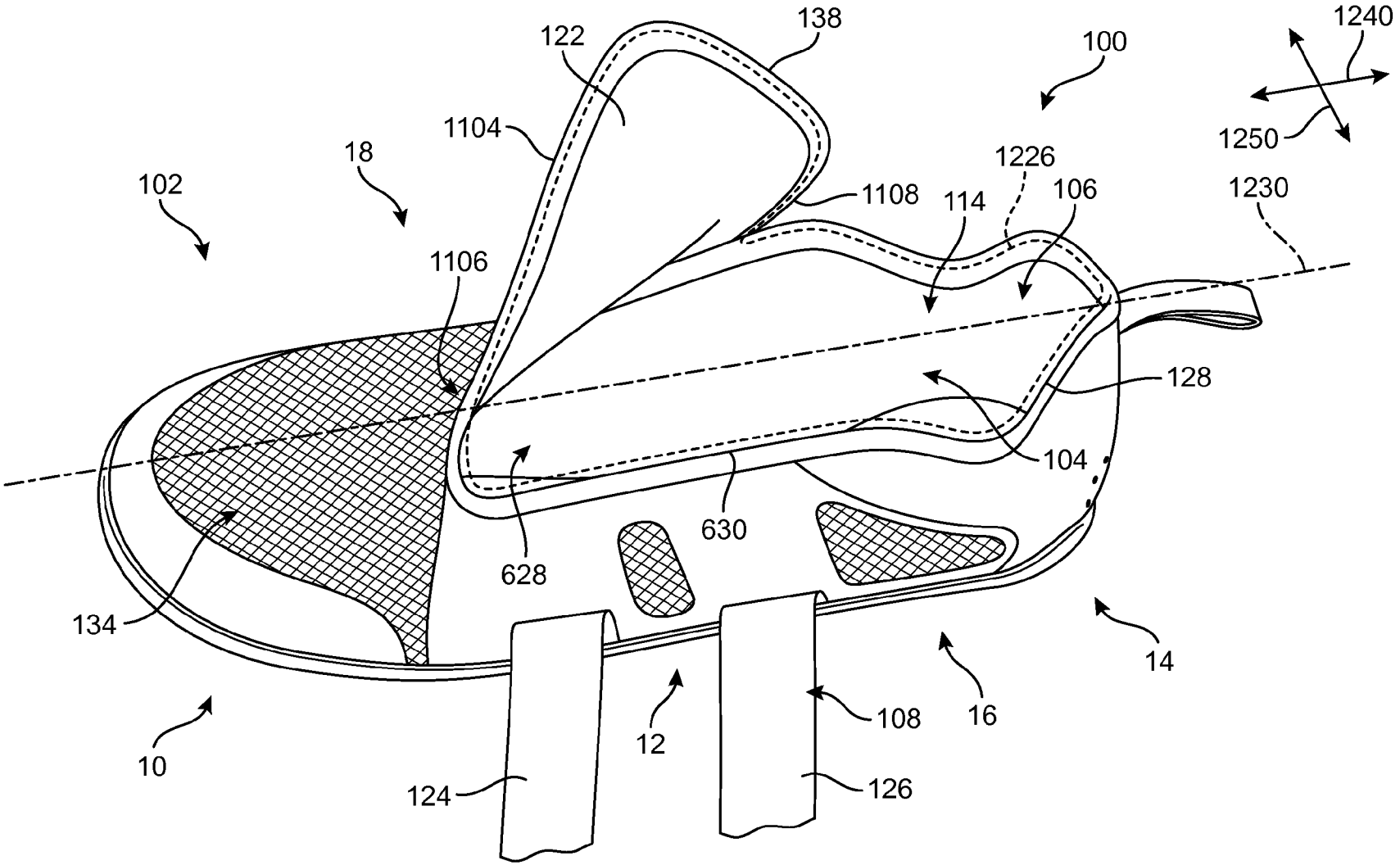
FIG. 12 is a schematic isometric view of an embodiment of an article of footwear including a fastening system and a tongue.

Thus, tongue 122 can be joined to upper 102 in such a way that a large part of tongue 122 is unattached, and free to be raised or lowered (e.g., lateral edge 1104, rear edge 138, and/or first medial edge 1108 can be unattached from upper 102). Referring now to FIG. 12, article 100 may accordingly include provisions for adjustment or movement of tongue 122 in some embodiments. For example, ninth anchor portion 1116 (shown in FIG. 11) and forward portion 1106 may act as two anchor points, which can join two different portions of tongue 122 to upper 102. Thus, tongue 122 may be moved upward along rear edge 138, and help form a larger entryway into interior cavity 106.

It should be understood that in some embodiments, the freedom of movement allowed tongue 122 and the freedom of movement allowed shield 132 may be similar or may differ. For example, in FIGS. 10 and 11 it can be seen that shield 132 may be rotated substantially along one side. In one embodiment, tongue 122 may be more limited in its range of movement relative to shield 132. In other embodiments, tongue 122 may be more or less anchored than depicted herein. For purposes of this disclosure, "anchored" refers to the extent that a component is fixedly attached to a surface.

Furthermore, the materials comprising tongue 122 may also affect the ability of tongue 122 to be adjusted or moved. Thus, in some embodiments, tongue 122 may include substantially flexible materials, allowing tongue 122 to be bent or curved back, giving the user more easy access to interior cavity 106, for example. In other embodiments, tongue 122 may include substantially rigid materials that inhibit the bending of tongue 122 and increase the amount of resistance of tongue 122 to deformation. In another embodiment, tongue 122 may include areas that are more flexible and areas that are more rigid.

In addition, referring to FIGS. 9-12, each of the components of upper 102 may vary in one or material properties or physical characteristics. In some embodiments, each member or component could be characterized by a rigidity or stiffness, which is the extent to which an object resists deformation. For example, first ventilation portion 134 may have a first stiffness, tongue 122 may have a second stiffness, and shield 132 may have a third stiffness. In at least some embodiments, the second stiffness of tongue 122 may be greater than the first stiffness of first ventilation portion 134. Also, in some embodiments, the second stiffness of tongue 122 may be greater than the third stiffness of shield 132. With such a configuration, first ventilation portion 134 and tongue 122 may be configured to bend, stretch, flex, or otherwise deform more easily than shield 132. In particular, this arrangement could allow for parts of upper 102 and tongue 122—directly in contact with a foot (or with a sock or other material that covers foot while the foot is disposed within article 100, for example)—to react dynamically to various movements of a foot as a user engages in various activities, while shield 132 provides improved strength, support, and/or protection along instep portion 13 of upper 102, where fasteners 108 or other bindings or straps may compress the foot. Of course, in other embodiments, the relative stiffness of each component could vary in any desired manner.

In some embodiments, article 100 may include provisions that facilitate the insertion of a foot into article 100, and allow rapid entry. Furthermore, similar provisions may facilitate the removal or rapid exit of a foot from article 100. Referring back to the sequence of embodiments of article 100 depicted in FIGS. 1-12, it can be seen that in some embodiments, as article 100 is loosened and components of upper 102 are adjusted, the entryway leading into interior cavity 106 may change in size and shape. In FIGS. 1-3, fastening system 120 is engaged, and upper 102 is in the secured state. For purposes of reference, the different sizes of opening 104 depicted in the figures are identified by a dotted line associated with the boundary of opening 104. It should be understood that the sizes depicted by the dotted lines are for illustrative purposes only, and the shapes and/or size of opening 104 may differ from those shown or labeled herein.

In the embodiment of FIG. 4, a portion of fasteners 108 have been raised, but a tension in fastening system 120 remains, and so opening 104 continues to have a first size 426 that is substantially similar to the size of opening 104 in FIGS. 1-3. In FIGS. 1, 2, and 4, the size of opening 104 is generally defined by the region associated with mouth 114, which is bounded by collar 128 and rear edge 138 of tongue. Referring to FIG. 6, fasteners 108 have been partially loosened, allowing some slack along instep portion 13, such that tongue 122 and/or shield 132 can be moved slightly if so desired. In FIG. 6, opening 104 has a second size 626, which is now defined by both mouth 114 and a small portion of a throat 628. Throat 628 is associated with the gap that may be formed between lateral edge 1104 of tongue 122 and an inner lateral edge 630 of upper 102 when tongue 122 is adjusted. The opening of throat 628 can be used to expand the overall opening 104 to interior cavity 106. Thus, in some embodiments, second size 626 is larger in area than first size 426.

In FIG. 7, fasteners 108 have been further loosened, forming first curved arch 702 and second curved arch 704 over the instep portion. In some embodiments, this may allow shield 132 and/or tongue 122 an increased freedom to move or be adjusted. As shown in FIG. 7, opening 104 has a third size 726, which is defined by both mouth 114 and a larger opening formed in throat 628. In some embodiments, third size 726 may be larger in area than second size 626 (shown in FIG. 6). Furthermore, in FIG. 8, first curved arch 702 and second curved arch 704 have been extended, allowing greater access to interior cavity 106. In some embodiments, this may allow shield 132 and/or tongue 122 to be moved to a greater degree than previously, within the region bounded by first curved arch 702, second curved arch 704 over instep portion 13. Thus, tongue 122 may be moved further upward, such that the opening associated with throat 628 can be enlarged. Opening 104 now has a fourth size 826 that may be greater than third size 726 (shown in FIG. 7) in some embodiments.

In FIG. 9, fasteners 108 have been pulled away from article 100. Shield 132 is free to move along its hinge points (i.e., first anchor portion 154 and/or fifth anchor portion 162, shown in FIGS. 2 and 10). As shield 132 is pulled upward and toward medial side 18, lateral edge 1104 of tongue 122 can also increase its distance from inner lateral edge 630. In other words, throat 628 may be further expanded, and opening 104 may increase in size to a size that is larger in area than fourth size 826 (shown in FIG. 8) in one embodiment. Finally, in the embodiment illustrated in FIG. 12, tongue 122 can be folded back even further toward medial side 18. Thus, although tongue 122 is attached to upper 102 along its medial tab portion 1112 (shown in FIG. 11) as well as forward portion 1106, it remains highly moveable. In other words, because tongue 122 remains free along rear edge 138, lateral edge 1104, and first medial edge 1108, it has the ability to be turned or bent to a large degree, exposing a significant area of throat 628. In FIG. 12, where upper 102 is in the open configuration, opening 104 has a fifth size 1226. Fifth size 1226 is greater than fourth size 826 (shown in FIG. 8) in some embodiments. In one embodiment, fifth size 1226 may represent the maximum size of opening 104. However, it should be understood that, in other embodiments, opening 104 may have a maximum size substantially greater than or less than that of fifth size 1226. For example, depending on the flexibility or thickness of the materials used in tongue 122, tongue 122 may have the ability to bend less or further toward medial side 18 of article 100 and form a larger opening.

With each enlargement of opening 104 as described herein, a user may be able to more readily slip on article 100 or remove article 100. In some embodiments, the quick release of fastening system 120 can permit a user to rapidly remove a foot and/or enter a foot into article 100. Furthermore, the configuration of shield 132, which may rotate (similar to a flap) over instep portion 13, may provide a user with a swift-motion mechanism for setting aside the outer layer of instep portion 13. This may allow a user to quickly expand or decrease the size of at least a portion of throat 628 in some embodiments. In addition, because tongue 122 is not attached along its lateral edge 1104, tongue 122 may be bent upward and toward medial side 18, giving a user prompt access to a larger opening leading to interior cavity 106. In some embodiments, it may also be desired that opening 104 be sized more widely (as shown herein), in comparison with conventional footwear (for example, shoes used in sports like baseball or track). For example, a larger opening 104 may also allow a rower to better avoid disturbance in the smooth movement of his or her ankle during a rowing action.

Thus, as there are no anchor portions associated with either tongue 122 or with shield 132 along lateral side 16, the passage or entryway into article 100 can be much larger than if tongue 122 and/or shield 132 were further joined to upper 102. In other words, throat 628 (shown in FIGS. 6-9) is able to stretch open to a far greater degree as tongue 122 and/or shield 132 may be bent, adjusted, or otherwise moved from lateral side 16 toward medial side 18. This can leave lateral side 16 of throat 628 relatively clear of obstacles for foot entry/exit in some embodiments.

It should be understood that shield 132 and/or tongue 122 may be disposed such that the gap associated with throat 628 is configured toward medial side 18, rather than lateral side 16 (as shown in the figures). In other words, in another embodiment, shield 132 may be arranged such that it is attached to upper 102 along lateral side 16, and detached along medial side 18. Similarly, tongue 122 may be freed along medial side 18, and be attached along lateral side 16 in another embodiment. Furthermore, fastening system 120 may also be arranged such that one or more of anchor portions 168 associated with fixed straps 148 are located along lateral side 16 in some embodiments. Thus, descriptions provided herein and in the claims may refer to two sides of article 100 demarcated by a central axis 1230 (shown in FIG. 12). Central axis 1230 may extend in a direction parallel to a longitudinal axis 1240 (shown in FIG. 12). In one embodiment, central axis 1230 may be generally equivalent to or aligned with a midline extending across the length of upper 102 in a longitudinal direction. Central axis 1230 may, in some cases, help demarcate article 100 into a first side and a second side along the lateral direction (as represented by a lateral axis 1250 (shown in FIG. 12)). The first side may be associated with lateral side 16, for example, and the second side may represent the corresponding medial side 18. In another case, the first side may be associated with medial side 18, and the second side may represent the corresponding lateral side 16. While the first side and the second side may not be identical (similar to the manner in which lateral side 16 and medial side 18 are not identical), they may include similar regions and sizes across upper 102.

Figure 13:
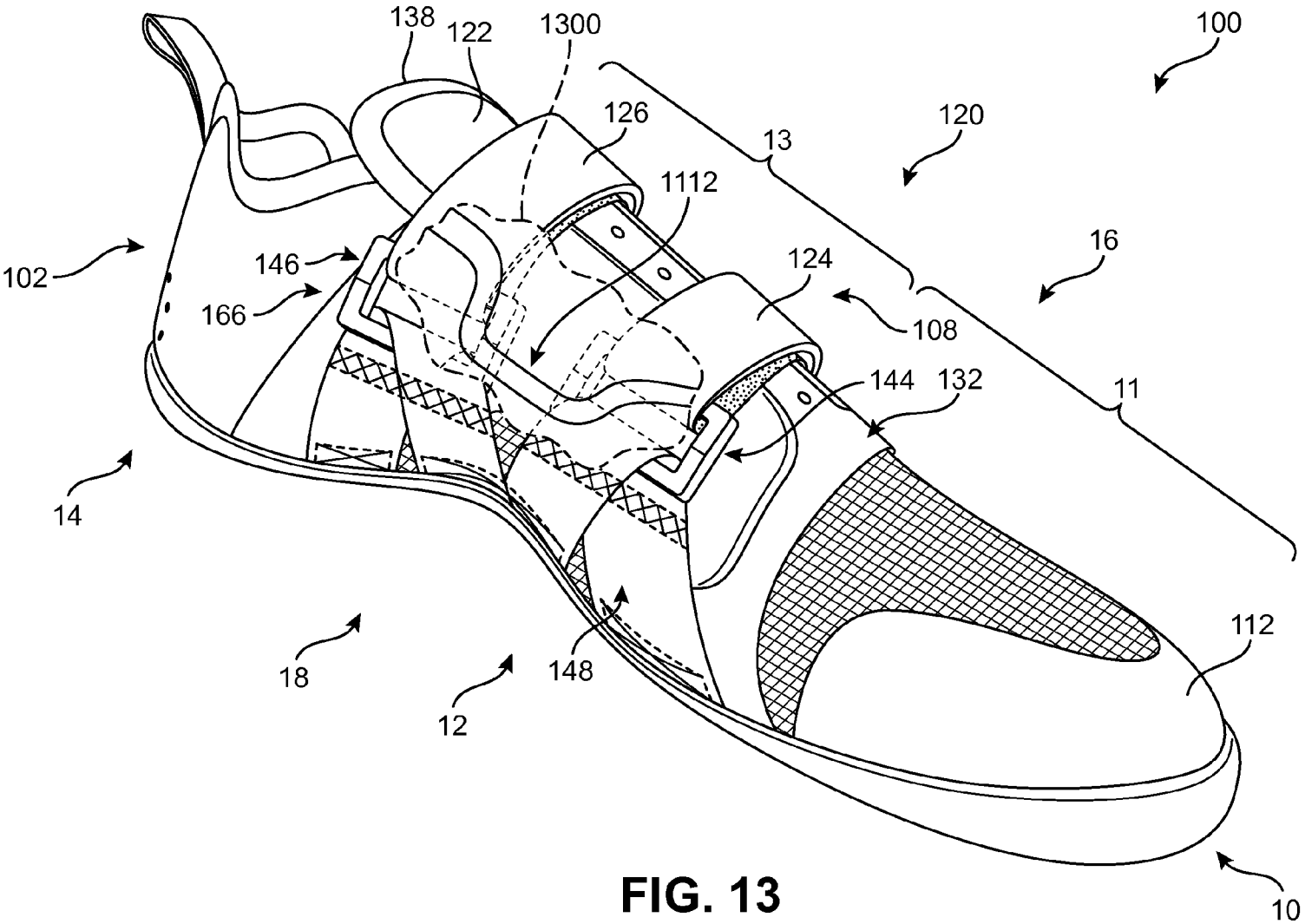
FIG. 13 is a schematic isometric view of an embodiment of an article of footwear with a cutaway view.

To better understand the manner in which various portions of upper 102 are joined, FIG. 13 presents a medial isometric view of article 100, including a cutaway region 1300. In cutaway region 1300, portions of fixed straps 148, receptacles 166, and fasteners 108 are shown in dotted line to expose a portion of tongue 122. In other words, the layer associated with tongue 122 can be seen beneath shield 132 and fastening system 120. As described earlier, fastening system 120, shield 132, and tongue 122 can be disposed such that they form a series of overlapping layers. For example, in FIG. 13, fastening system 120 has been configured such that first fastener 124 and second fastener 126 are folded and extend over instep portion 13. Fasteners 108 extend through receptacles 166 along medial side 18. Fixed straps 148 also join receptacles 166 along medial side 18. Adjacent to receptacles 166 and fixed straps 148 in an inward direction (i.e., toward exterior surface 112 of article 100) is the layer associated with shield 132. In one embodiment, the portion of tongue 122 associated with rear edge 138 can also be seen near second fastener 126, toward heel portion 14.

The relationship of each of these elements with one another can be best understood in cutaway region 1300, where a portion of first fastener 124, second fastener 126, first receptacle 144, second receptacle 146, and shield 132 have been depicted in a transparent manner. Thus, cutaway region 1300 in the embodiment of FIG. 13 reveals an area of upper 102 beneath fastening system 120 and shield 132. In this case, the exposure reveals a part of medial tab portion 1112 of tongue 122. In some cases, each of fixed straps 148 and shield 132 can both be joined to medial side 18 of upper 102, in an overlapping manner. In another embodiment, a portion of tongue 122 may also be joined along medial side 18 of upper 102, adjacent to shield 132. In other words, in the embodiment of FIG. 13, portions of shield 132 may be understood to be "sandwiched" between portions of tongue 122 and portions of fastening system 120. It should be understood that in other embodiments, tongue 122 may instead be "sandwiched" between shield 132 and fastening system 120. The extent to which each element is layered or sandwiched between other elements can vary as article 100 transitions from the closed configuration to the open configuration.

Figure 14:
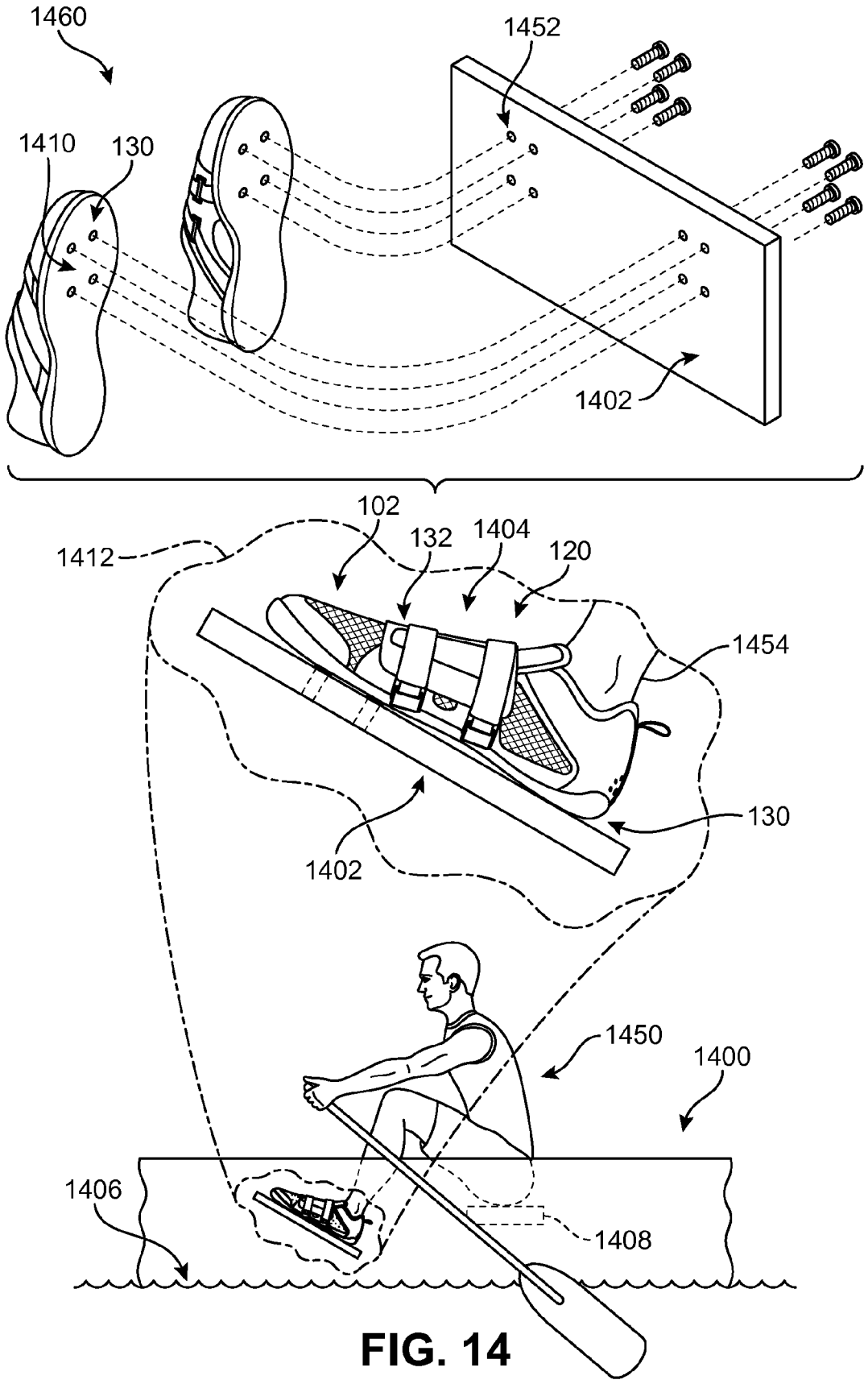
FIG. 14 is a schematic view of an embodiment of an article of footwear utilized in a water activity.

Referring to FIG. 14, a portion of a vessel 1400 is illustrated. Vessel 1400 may be a conventional rowing boat, such as rowing boats used for leisure activities and/or in competitive sports. For example, vessel 1400 can be a sweep-oar boat, a canoe-like watercraft, or any boat where one or more of the occupants row and need their feet to be secured within the boat to enhance rowing actions. A conventional rowing boat can have a binding structure 1402 fixedly disposed near the bottom of vessel, adjacent to a hull 1406 or a seat structure 1408.

An article 1404 worn by a rower 1450 is depicted in FIG. 14, illustrated in accordance with embodiments of the present disclosure. Binding structure 1402 may include a mechanism for releasably securing a pair of articles of footwear such that rower 1450 can apply both pulling and pushing pressure on binding structure 1402 while rowing. Binding structure 1402 may have a variety of configurations in different embodiments.

FIG. 14 illustrates one example of how a pair of articles may be utilized. In a magnified view 1412 of the footwear, it can be seen that in one embodiment, sole structure 130 of each of a pair of articles 1460 can include a mounting portion 1410. In one embodiment, mounting portion 1410 may comprise one or more bolts, cleats, fasteners, or other structures. Mounting portion 1410 may be configured so to attach or mount on or with binding structure 1402. Thus, binding structure 1402 may include recesses, apertures, or receiving portions 1452 dimensioned to quickly connect with or snap onto mounting portion 1410. In other embodiments, mounting portion 1410 may differ, such that it includes holes or recesses to join with structures formed on binding structure 1402.

Thus, in some cases, it may be beneficial to provide a user with a facilitated method of removing a foot 1454 from article 1404, without necessarily dismounting or detaching from binding structure 1402. In other words, some users may wish to pull their feet out of an article without first removing the article from vessel 1400. In such cases, having a simple and rapid exit system, as described in the embodiments herein, may be useful. Furthermore, a user may then wish to reenter the article quickly. In these cases, the rapid entry system described in the embodiments disclosed herein can facilitate the insertion of the user's foot into the article.

Figure 15:
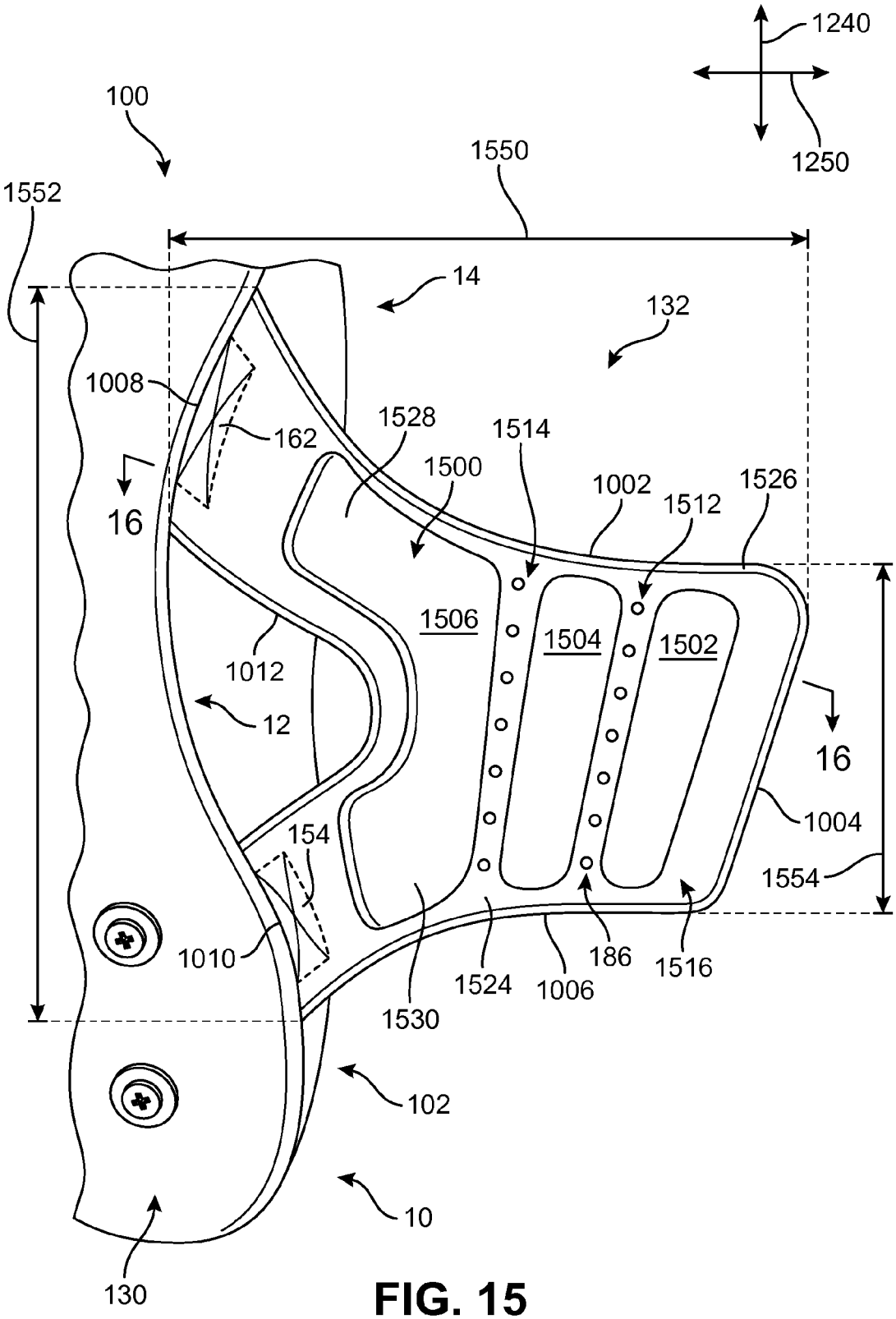
FIG. 15 is a schematic top-down view of an embodiment of a shield.
Figure 16:
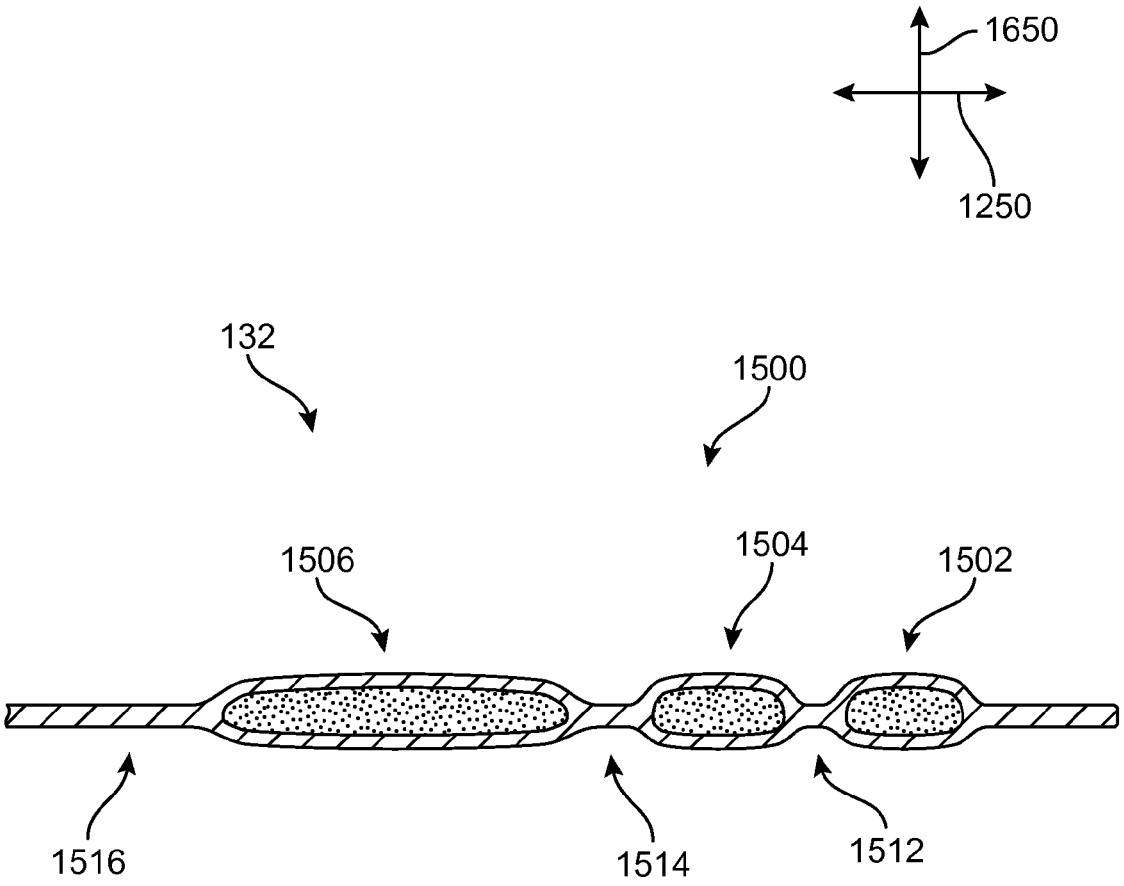
FIG. 16 is a lateral cross-sectional view of an embodiment of the shield.

Furthermore, during an activity like rowing, a user may exert a relatively large force along the instep portions of a pair of articles. Articles 1460 may include provisions for protecting, cushioning, or otherwise dispersing the amount of force directed to various regions of foot 1454. In some embodiments, shield 132 may be configured to protect and/or cushion various regions of foot 1454. Referring now to FIGS. 15 and 16, shield 132 is shown in isolation for purposes of illustration. FIG. 15 is a top-down view of shield 132 joined to a portion of article 100, and FIG. 16 is a cross-sectional view of shield 132.

In different embodiments, the dimensions of shield 132 could vary. As noted above, in some embodiments, shield 132 has a width and a length that generally extends over the region of the upper associated with the instep portion. In another embodiment, shield 132 could have a length less than or greater than the length of the instep portion. In some embodiments, shield 132 may include a generally consistent length throughout shield 132. In another embodiment, shield 132 may extend through both the forefoot portion and the midfoot portion. In other embodiments, shield 132 can include lengths that vary over different portions of shield. For example, shield 132 is shown to include a first length 1552 in FIG. 15, extending from forefoot portion 10, through midfoot portion 12, and adjacent to heel portion 14, along one side. Along the opposing side, shield 132 includes a second length 1554, extending through midfoot portion 12, and over substantially all of the instep portion of upper 102. It can be seen that second length 1554 is smaller than first length 1552 in FIG. 15.

Furthermore, in some cases, shield 132 may have a width that is generally constant throughout shield 132. In other embodiments, shield 132 may vary in width along one portion relative to another portion. For example, shield 132 can curve or otherwise change in width along lateral axis 1250 in one embodiment. As depicted in FIG. 15, in some embodiments, shield 132 has a maximum width 1550 that may be approximately equal to the width of upper 102 (i.e., the width associated with the curvature of upper 102, extending from the medial side to the lateral side). Thus, in one embodiment, shield 132 may extend over substantially the entire lateral width (along lateral axis 1250) of upper 102, along midfoot portion 12. In another embodiment, shield 132 may be wider or narrower than upper 102. As shown in FIG. 15, some areas of shield 132 may cover only a portion of upper 102 (e.g., the area of shield associated with medial curved edge 1012 on one side). Thus, in other embodiments, shield 132 could only extend partially across the width of upper 102 in a lateral direction.

In different embodiments, shield 132 may include areas that comprise materials that can provide greater cushioning and durability. For example, in FIG. 15, shield 132 includes a plurality of padded regions 1500. Examples of possible cushioning materials that could be used in shield 132 to form padded regions 1500 include, but are not limited to, bladders, foam structures (closed cell or open cell), textile materials, devices incorporating springs, as well as other kinds of cushioning materials. In one embodiment, padded regions 1500 may comprise a bladder filled with air or a kind of fluid. Specifically, a padded region may comprise an outer material layer that encloses a sealed interior chamber. Thus, the user can engage in a rowing stroke and the configuration of padded regions 1500 may provide greater comfort in regions compressed against the foot by one of the fasteners or other binding components that are disposed adjacent to the upper.

In some embodiments where foam is included in padded regions 1500, the padding may have a density of between approximately 1-7 pct (pounds per cubic foot). Furthermore, in one embodiment, the padding may have a compression strength of between approximately 2-30 psi (pounds per square inch) at approximately 25% deflection, and a compression strength of between approximately 7-50 psi at approximately 50% deflection. The padding may have a tensile strength of between approximately 20-160 psi in some embodiments. However, in other embodiments, the padding density, compression strength, and/or tensile strength can lie outside of the ranges listed herein.

The degree of compression that portions of shield 132 may withstand for a given force can vary according to factors including, but not limited to, desired cushioning properties, shield structure materials, shield structure geometry as well as possibly other factors. Moreover, the regions of padding in shield 132 can be tuned to achieve optimal comfort and cushioning for a user.

Shield 132 may include one or more padded regions 1500. In one embodiment, padded regions 1500 may comprise a substantial majority of shield 132, and/or there may be a single padded region that extends across the length and width of shield 132. In other embodiments, shield 132 may include between one and five padded regions. In different embodiments, shield 132 may include more than five padded regions. In the embodiment of FIGS. 15 and 16, padded regions 1500 include a first padded region 1502, a second padded region 1504, and a third padded region 1506.

Padded regions 1500 may include various shapes. In some embodiments, a padded region may be round, square, rectangular, polygonal, or comprise any other regular or irregular shape. Padded regions 1500 or other parts of shield 132 may also exhibit textures or other surface characteristics, such as dimpling, protrusions, ribs, or various patterns. In one embodiment, first padded region 1502 and second padded region 1504 may comprise substantially elongated shapes. In another embodiment, third padded region 1506 may approximately comprise a U-shape, or an otherwise curved shape. In one embodiment, third padded region 1506 may have an arch-like shape. Furthermore, shield 132 may include a first arm 1528 and a second arm 1530 that may comprise portions of third padded region 1506. First arm 1528 may be attached to upper 102 via fifth anchor portion 162 and second arm 1530 may be attached to upper 102 via first anchor portion 154 in some embodiments.

In some embodiments, each portion of padded regions 1500 may be surrounded by a border area 1516 of shield 132. Border area 1516 may not include padding, or may include substantially less padding than padded regions 1500. The thickness of the shield material along border area 1516 can be chosen based upon various factors, including the degree of mobility desired.

In one embodiment, border area 1516 extends around (bounds) each portion of padded regions 1500. For purposes of reference, in the embodiment of FIG. 15, border area 1516 may also be divided into an inner border 1524 and an outer border 1526. Outer border 1526 may be associated with the outer periphery of shield 132. In some embodiments, outer border 1526 may be slightly more rigid, have less flexibility, or vary in thickness from inner border 1524. Inner border 1524 may be disposed more inward (e.g., toward the center of shield 132) than outer border 1526.

As shown in FIG. 15, in one embodiment, inner border 1524 may be further divided into a first intermediate region 1512, and a second intermediate region 1514. In some embodiments, first intermediate region 1512 may be disposed between first padded region 1502 and second padded region 1504, and second intermediate region 1514 may be disposed between second padded region 1504 and third padded region 1506.

Shield 132 may also include provisions for drainage, breathability, quick drying, and/or ventilation, as described with respect to ventilation portions and apertures above. In some embodiments, shield 132 may include one or more apertures 186. As shown in FIG. 15, shield 132 includes a third set of apertures associated with first intermediate region 1512 and a fourth set of apertures associated with second intermediate region 1514.

Thus, in different embodiments, shield 132 may be configured to help mitigate the effect of various forces applied to the instep portion of a foot. It should be understood that while padded regions 1500 may comprise approximately uniform thickness and/or padding in some embodiments, in other embodiments, the thickness and/or padding within a single padded region can vary. In FIG. 16, a cross-section of shield 132 is illustrated. First padded region 1502, second padded region 1504, and third padded region 1506 are shown with substantially similar thicknesses. However, in other embodiments, the thickness could vary. For example, first padded region 1502 may include a greater thickness than second padded region 1504. Furthermore, the thickness of each portion of padded regions 1500 may vary within a single padded region. In one embodiment, shield 132 has a thickness that varies throughout shield 132. In other words, there are regions where shield 132 includes regions of greater thickness. The relatively greater regions of thickness may ensure that shield 132 provides a larger degree of the shock absorption, cushioning, and/or support than may be provided by the material structures of upper 102 and/or tongue 122.

In addition, in some embodiments, portions of shield 132 could be thicker than either the remainder of upper 102 or tongue 122. In other embodiments, portions of shield 132 could be thinner than upper 102. In some cases, portions of shield 132 could be equal in thickness to an upper and/or a sole structure.

Figure 17:
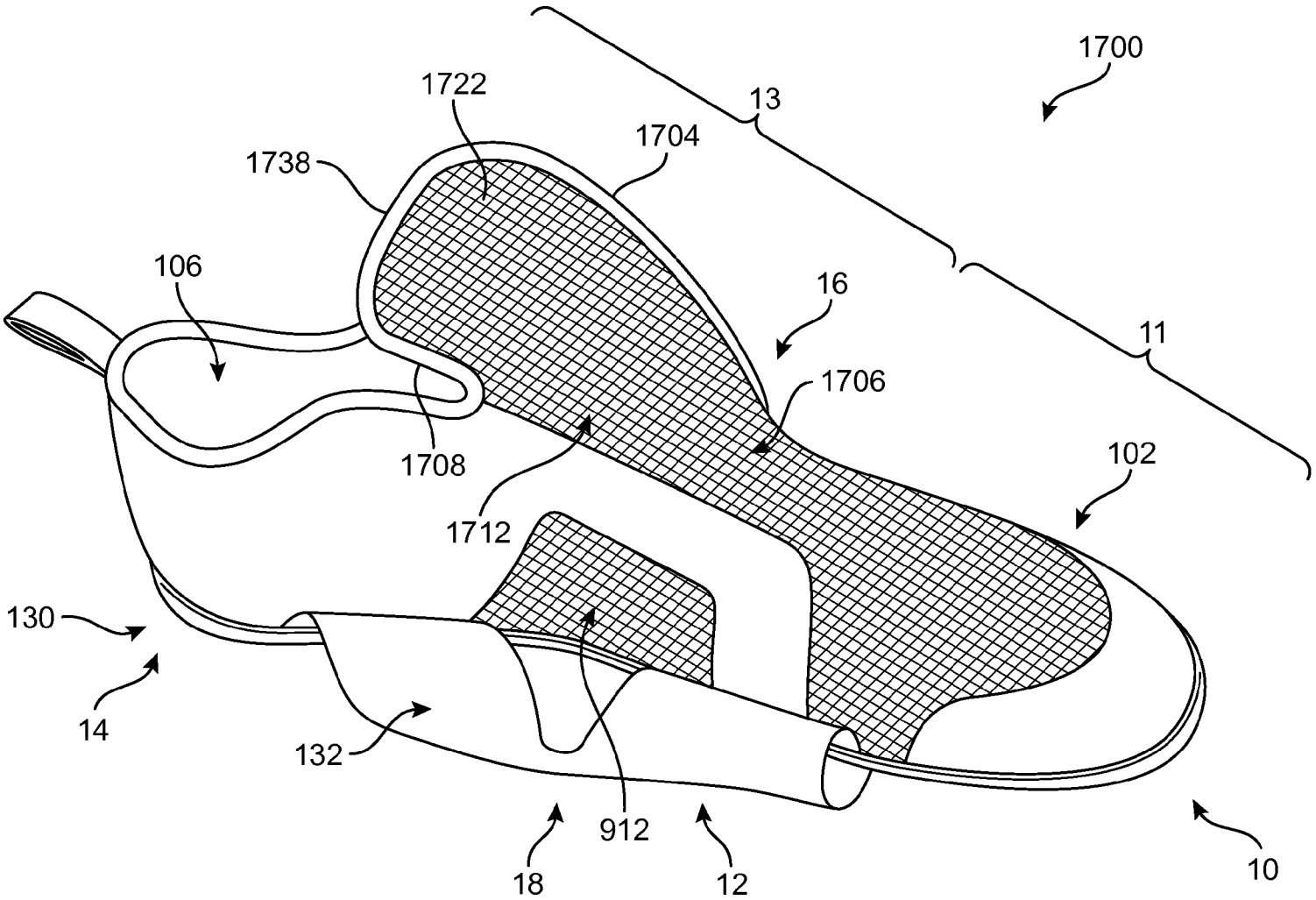
FIG. 17 is a schematic isometric view of an embodiment of an article of footwear including an upper with a tongue and a sole structure.

In different embodiments, the tongue may be different from tongue 122 described above. In one embodiment, a tongue can include dimensions and/or edges that differ from those described with respect to tongue 122. For example, referring to FIGS. 17 and 18, a second embodiment of tongue 1722 is depicted, joined to upper 102 of an article of footwear ("article") 1700. For purposes of reference, the outer perimeter of tongue 1722 may be divided into a rear edge 1738, a lateral edge 1704, a forward portion 1706, a medial edge 1708, and a medial portion 1712 (as shown in FIG. 17).

In some embodiments, the shape of tongue 1722 may vary. In one embodiment, the shape of tongue 1722 may resemble a generally continuous or smooth oblong rectangular or trapezoidal shape. In other embodiments, the perimeter and shape of tongue 1722 may vary from what is depicted here, and include any regular or irregular shape. For example, referring to FIGS. 11 and 12, tongue 122 may include medial tab portion 1112. However, in the embodiment of FIGS. 17 and 18, a relatively small portion of the medial side is unattached (medial edge 1708), and there is no medial tab portion.

Tongue 1722 may be joined to upper 102 in various ways. In some embodiments, tongue 1722 may be joined along multiple edges to upper 102. In other cases, tongue 1722 may be joined to upper 102 along two or more sides of tongue 1722 to form an integrated structure along upper 102. In other embodiments, tongue 1722 may be joined along only one side to upper 102. As shown in FIG. 17, in some embodiments, forward portion 1706 of tongue 1722 is joined to upper 102 near vamp portion 11. Furthermore, in one embodiment, forward portion 1706 may be integrally joined to vamp portion 11, forming a smooth, continuous region. In other embodiments, forward portion 1706 may be joined in a manner described previously with respect to anchor portions above.

In addition, in some embodiments, medial portion 1712 of tongue 1722 can be joined to upper 102 along instep portion 13 of medial side 18 of upper 102. Furthermore, similar to forward portion 1706, in one embodiment, medial portion 1712 may be integrally joined to instep portion 13, forming a smooth, continuous region. In other embodiments, however, medial portion 1712 may be joined in a manner described previously with respect to anchor portions above.

Figure 18:
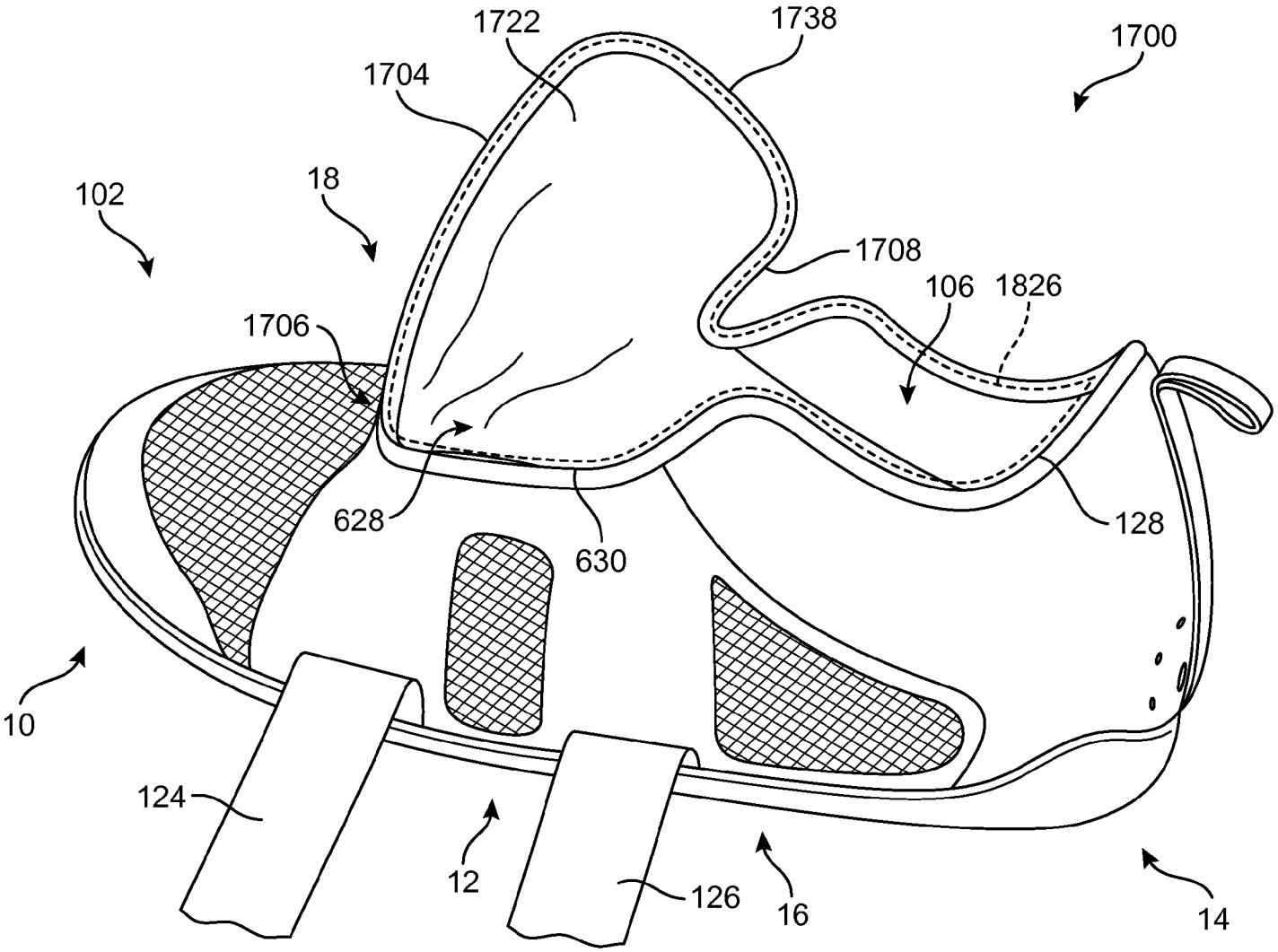
FIG. 18 is a schematic isometric view of an embodiment of an article of footwear including a fastening system and a tongue.

As noted above, generally if the tongue of an article of footwear slips or moves too far over toward one side of the article, the article may be uncomfortable for the user. Thus, article 1700 can include provisions for ensuring tongue 1722 is sufficiently secured to the upper. In one embodiment, by including a continuous integrated portion (for example, medial portion 1712) along one side of upper 102, tongue 1722 may be anchored against excessive or uncomfortable sliding or movement over a foot. As shown in FIGS. 17 and 18, medial portion 1712 is joined to upper 102 such that there is a substantially continuous attachment along medial side 18 between medial portion 1712 and instep portion 13. Such an arrangement also provides the advantage of maintaining tongue 1722 in an optimum center position, if desired.

Furthermore, in some embodiments, tongue 1722 can be joined to upper 102 in such a way that a large part of tongue 1722 remains unattached, and is free to be raised or lowered (e.g., lateral edge 1704, rear edge 1738, and/or medial edge 1708 can be unattached from upper 102). Referring now to FIG. 18, article 1700 may accordingly include provisions for adjustment or movement of tongue 1722 in some embodiments. For example, medial portion 1712 and forward portion 1706 (shown in FIG. 17) may act as two anchor points, which can join two different portions of tongue 1722 to upper 102. Thus, tongue 1722 may be moved upward along rear edge 1738, medial edge 1708, and/or lateral edge 1704, and facilitate the formation of a larger entryway into interior cavity 106.

It should be understood that in some embodiments, the freedom of movement allowed tongue 1722 and the freedom of movement allowed shield 132 (shown curled under sole structure 130 in FIG. 17) may be similar or may differ. For example, referring to FIGS. 10, 11, and 17 it can be seen that shield 132 may be rotated substantially along one side, and can be generally pivoted from medial side 18 to lateral side 16. In one embodiment, tongue 1722 may be more limited in its range of movement than shield 132. In other embodiments, tongue 1722 may be more or less anchored than depicted herein.

In FIG. 18, first fastener 124 and second fastener 126, as well as shield 132 (not shown in FIG. 18) have been pulled away from article 1700. Thus, lateral edge 1704 of tongue 1722 can also increase its distance from inner lateral edge 630. In other words, throat 628 may be further expanded, and opening 104 may increase in size to a size that is larger in area than fourth size 826 (shown in FIG. 8) in one embodiment. In the embodiment illustrated in FIG. 18, tongue 1722 is folded back further toward medial side 18. Thus, although tongue 1722 is attached to upper 102 along its medial portion 1712 as well as forward portion 1706 (see FIG. 17), it remains highly moveable. In other words, because tongue 1722 remains free along rear edge 1738, lateral edge 1704, and medial edge 1708, it has the ability to be turned or bent to a large degree, exposing a significant area of throat 628. In FIG. 18, where upper 102 is in the open configuration (similar to FIG. 12), opening 104 has a sixth size 1826. Sixth size 1826 is greater than fourth size 826 (shown in FIG. 8) in some embodiments. In one embodiment, sixth size 1826 may represent the maximum size of opening 104. However, it should be understood that, in other embodiments, opening 104 may have a maximum size substantially greater than or less than that of sixth size 1826. For example, depending on the flexibility or thickness of the materials used in tongue 1722, tongue 1722 may have the ability to bend less or further toward medial side 18 of article 1700 and form a larger opening. In some embodiments, sixth size 1826 may be greater or smaller than fifth size 1226 (shown in FIG. 12). In one embodiment, sixth size 1826 may be substantially similar to fifth size 1226.

Thus, the additional embodiment depicted herein in FIGS. 17 and 18 may also allow a user to quickly expand or decrease the size of at least a portion of throat 628 in some embodiments. In addition, because tongue 1722 is not attached along its lateral edge 1704, tongue 1722 may be bent upward and toward medial side 18, giving a user prompt access to a larger opening leading to interior cavity 106. In some embodiments, it may also be desired that opening 104 be sized more widely (as shown herein), in comparison with conventional footwear (for example, shoes used in sports like baseball or track). For example, a larger opening 104 may also allow a rower to better avoid disturbance in the smooth movement of his or her ankle during a rowing action. This can leave lateral side 16 of throat 628 relatively clear of obstacles for foot entry/exit in some embodiments.

Furthermore, the continuous, smooth configuration of tongue 1722 illustrated in FIGS. 17 and 18 may provide a user with relatively greater comfort or fit in some embodiments. In one embodiment, the inclusion of an upper 102 unitarily integrated or continuous with tongue 1722 can reduce the bumpiness of the external and/or internal surface of article 1700. In another embodiment, tongue 1722 can help minimize possible snagging of the upper with other objects. In addition, because there is a continuous unbroken region (i.e., closed surface) adjoining forward portion 1706 and medial portion 1712, there is less likelihood of debris or other particles entering interior cavity 106. In some embodiments, the inclusion of a smooth, continuous region between tongue 1722 and upper 102 may also facilitate the manufacturing of article 1700. In another embodiment, the continuous region between tongue 1722 and upper 102 can as improve the resilience of tongue to displacement and/or improve the ability of tongue 1722 to withstand repeated deformation and/or exposure to various pulling forces.

The material comprising tongue 1722 in FIGS. 17 and 18 can differ from tongue 122 of FIGS. 1-13, or be similar. In one embodiment, tongue 1722 can include sections made of waterproof materials and/or other sections made of air permeable materials that allow for interior cavity 106 to breathe or ventilate. For example, tongue 1722 may include one or more ventilation portions. In some embodiments, the ventilation portions could be mesh portions formed from any kinds of textile materials. Mesh materials can facilitate drainage, breathability, quick drying, and/or ventilation of the foot. In other embodiments, tongue 1722 may be formed from materials similar to those of tongue 122 and/or upper 102 described earlier.

This description of features, systems, and components is not intended to be exhaustive and in other embodiments, article 100 may include other features, systems, and/or components. Moreover, in other embodiments, some of these features, systems, and/or components could be optional. As an example, some embodiments may not include a second fastener or a border.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, the article of footwear comprising:

an upper;

the upper comprising a fastening system, a shield, and a tongue;

the fastening system including a first fastener and a first fixed strap, the first fastener comprising an elongated strap, the elongated strap including a hook portion and a loop portion, the hook portion being engaged to the loop portion in a closed configuration of the article of footwear;

the shield being disposed between the first fastener and the tongue when the article of footwear is in the closed configuration;

the upper comprising a longitudinal direction, a lateral direction, a forefoot portion, a heel portion, a vamp portion, and a midline;

a central axis extending in the longitudinal direction from the forefoot portion to the heel portion, the central axis being approximately aligned with the midline of the article of footwear, and the central axis dividing the upper into two opposing sides across the lateral direction;

the two sides of the upper comprising a first side and a second side;

the first fixed strap being attached along the second side of the upper;

the shield including a first edge, and the tongue including a second edge;

the first edge of the shield being attached to a first portion of the second side, wherein the shield is detached along an entirety of the first side of the upper;

the second edge of the tongue including a forward portion and a side portion, the forward portion being joined to a portion of the vamp portion that is associated with the central axis, the side portion being attached to a second portion of the second side by a first anchor portion that comprises a stitched region of the upper, wherein the tongue is detached along a region that extends between the first anchor portion and the forward portion, and wherein the tongue is also detached along the first side of the upper; and wherein the first fastener is configured to extend in a substantially lateral direction over the shield and secure the article of footwear when tension is applied to the first fastener.

2. The article of footwear according to claim 1, wherein the tongue is disposed beneath the shield.

3. The article of footwear according to claim 1, wherein the shield includes at least one padded region.

4. The article of footwear according to claim 1, wherein the first edge of the shield is attached to the first portion of the second side by a second anchor portion, wherein the first fixed strap is also attached to the upper by the second anchor portion, and wherein the second anchor portion comprises a stitched region of the upper.

5. The article of footwear according to claim 1, wherein the second side is associated with a medial side of the upper.

6. The article of footwear according to claim 1, wherein the first fixed strap includes a receptacle that is configured to receive the first fastener, and wherein the fastening system is configured to provide a wrapping tension to a portion of the article of footwear when the hook portion and the loop portion are engaged.

7. An article of footwear, the article of footwear comprising:

a lateral side and a medial side;

an upper, a fastening system, a tongue and a shield disposed between at least a portion of the fastening system and the tongue;

a forefoot portion, a midfoot portion, a heel portion, a vamp portion, an instep portion, a mouth, an opening, and an interior cavity;

wherein the opening provides access for a foot into the interior cavity of the upper;

the instep portion including an inner lateral edge;

the shield having a medial edge attached to the medial side of the upper by one or more anchor portions, wherein the shield can be turned about the one or more anchor portions;

the tongue including a lateral edge, a forward portion, a medial tab portion, a medial edge, and a rear edge, wherein the medial edge extends between the medial tab portion and the forward portion, wherein the lateral edge is detached from the upper, wherein the forward portion is joined to the upper, wherein the medial tab portion is attached to the medial side of the upper, wherein the medial edge is detached from the upper, wherein the rear edge is detached from the upper, and wherein the tongue can be turned about the medial tab portion and the forward portion;

the upper having a secured state wherein the opening is a first size, and the upper having an open state wherein the opening is a second size, wherein the second size is larger than the first size;

wherein the fastening system comprises at least one elongated strap secured to a lateral or medial side of the upper and at least one fixed strap secured to a side of the upper opposite the one or more elongated straps;

wherein the upper is in the secured state when the shield is disposed over the instep portion, the lateral edge of the tongue contacts the lateral side of the instep portion, and the at least one elongated strap is joined to the at least one fixed strap to apply tension to the upper;

wherein the upper is in the open state when the fastening system is loosened, the shield is turned toward the medial side, and the lateral edge of the tongue is turned and disposed on the medial side of the article of footwear;

wherein the instep portion includes a throat opening in the open state, wherein the throat opening extends continuously between the lateral edge of the tongue and the inner lateral edge of the instep portion, and wherein the throat opening is continuous with the mouth;

wherein the opening is associated with the mouth in the secured state, and wherein the opening is associated with both the mouth and the throat opening in the open state.

8. The article of footwear according to claim 7, wherein the opening extends between the heel portion and the vamp portion in the open state.

9. The article of footwear according to claim 7, wherein the shield includes a first padded region and a second padded region, and wherein the shape of the first padded region differs from the shape of the second padded region.

10. The article of footwear according to claim 9, wherein the first padded region is approximately arch-shaped.

11. The article of footwear according to claim 7, wherein the lateral edge of the tongue is configured to be moved away from the inner lateral edge of the upper to enlarge the throat opening.

12. The article of footwear according to claim 7, further comprising at least one ventilation portion.

* * * * *